US011842836B2

(12) United States Patent
Suzuki et al.

(10) Patent No.: US 11,842,836 B2
(45) Date of Patent: Dec. 12, 2023

(54) REACTOR

(71) Applicant: TAMURA CORPORATION, Tokyo (JP)

(72) Inventors: Kotaro Suzuki, Sakado (JP); Yasuhiro Uekusa, Sakado (JP)

(73) Assignee: TAMURA CORPORATION, Tokyo (JP)

( * ) Notice: Subject to any disclaimer, the term of this patent is extended or adjusted under 35 U.S.C. 154(b) by 681 days.

(21) Appl. No.: 16/962,737

(22) PCT Filed: Jan. 16, 2019

(86) PCT No.: PCT/JP2019/001154
§ 371 (c)(1),
(2) Date: Jul. 16, 2020

(87) PCT Pub. No.: WO2019/142838
PCT Pub. Date: Jul. 25, 2019

(65) Prior Publication Data

US 2020/0357558 A1 Nov. 12, 2020

(30) Foreign Application Priority Data

Jan. 17, 2018 (JP) ..... 2018-005989

(51) Int. Cl.
*H01F 27/32* (2006.01)
*H01F 27/02* (2006.01)
(Continued)

(52) U.S. Cl.
CPC ..... *H01F 27/022* (2013.01); *H01F 27/24* (2013.01); *H01F 27/28* (2013.01); *H01F 41/0246* (2013.01); *H01F 41/04* (2013.01)

(58) Field of Classification Search
CPC ..... H01F 27/022; H01F 27/24; H01F 27/28; H01F 27/22; H01F 27/324; H01F 37/00; H01F 3/14; H01F 27/02
See application file for complete search history.

(56) References Cited

U.S. PATENT DOCUMENTS

2013/0099883 A1* 4/2013 Sato ..... H01F 27/22 336/55
2013/0300528 A1* 11/2013 Nobusaka ..... H01F 30/06 336/178
(Continued)

FOREIGN PATENT DOCUMENTS

CN 101567249 A 10/2009
CN 102483988 A 5/2012
(Continued)

OTHER PUBLICATIONS

Chinese Office Action dated Aug. 4, 2021 corresponding to application No. 201980007650.X.
Office Action for the corresponding Chinese Application No. 201980007650.X dated May 7, 2022 and its English machine translation.

*Primary Examiner* — Mang Tin Bik Lian
(74) *Attorney, Agent, or Firm* — Nath, Goldberg & Meyer; Jerald L. Meyer; Morgan D. Rosenberg

(57) ABSTRACT

A reactor capable of suppressing a deformation of a resin material in a gap between partial cores is provided. This reactor includes: a core that includes T-shaped cores which are at least a pair of partial cores disposed via the gap therebetween; a coil attached to respective parts of the T-shaped cores; and a core casing that is a core molding member which is formed integrally by a resin material and which covers the T-shaped cores. The core casing includes the coupling portion that is provided between the T-shaped cores at a location corresponding to the gap, and the cou-
(Continued)

pling portion is provided with a through-hole, and a pair of connection portions which face with each other across the through-hole and which connects a space between the T-shaped cores.

13 Claims, 18 Drawing Sheets

(51) Int. Cl.

| | |
|---|---|
| ***H01F 27/24*** | (2006.01) |
| ***H01F 27/28*** | (2006.01) |
| ***H01F 41/02*** | (2006.01) |
| ***H01F 41/04*** | (2006.01) |

(56) References Cited

U.S. PATENT DOCUMENTS

| | | | | |
|---|---|---|---|---|
| 2016/0055953 | A1* | 2/2016 | Hirata | H01F 27/327<br>336/96 |
| 2019/0027295 | A1* | 1/2019 | Hirabayashi | H01F 27/022 |
| 2019/0198238 | A1* | 6/2019 | Adar | H01F 27/28 |

FOREIGN PATENT DOCUMENTS

| | | | |
|---|---|---|---|
| CN | 106030734 | A | 10/2016 |
| JP | 2006-294830 | A | 10/2006 |
| JP | 2010-238798 | A | 10/2010 |
| JP | 2016-66751 | A | 4/2016 |

* cited by examiner

REACTOR

CROSS-REFERENCE TO RELATED APPLICATION

This is a National Phase Application filed under 35 U.S.C. 371 as a national stage of PCT/JP2019/001154, filed Jan. 16, 2019, an application claiming the benefit of Japanese Application No. 2018-005989, filed Jan. 17, 2018, the content of each of which is hereby incorporated by reference in its entirety.

FIELD OF THE INVENTION

The present disclosure relates to a reactor.

BACKGROUND

A reactor is used for various electrical apparatuses, and includes a reactor main body that includes a core and a coil wound around the circumference of the core, and a casing that houses therein the reactor main body. The core is often formed by combining a plurality of partial cores, and in this case, a magnetic gap may be formed between the partial cores. This gap may be formed of an air gap, or a resin material, such as a spacer, may be present therebetween.

Problem to be Solved by the Invention

In order to ensure the insulation between the core and the coil, all or a part of the core is embedded in the resin material by molding. In this case, in the magnetic gap between the partial cores, since no core is present and is solid that is entirely filled by the resin material, the resin material becomes thick. However, the resin material near the solid portion in the gap is likely to be deformed by so-called sink mark. That is, when the resin material which covers the surroundings of a protruding portion of the core adjacent to the solid portion becomes thin due to shrinkage caused when the resin material becomes a low-temperature and cured state from a high-temperature state with fluidity, bend and concavity are caused, and a change such as the partial cores being displaced from the proper positions relative to each other occurs.

In contrast, when the resin material is thin, since the strength of such a portion is small, a deformation is likely to occur, and the relative positions of the partial cores become unstable. When the positions of the partial cores change, a distance between the core and the coil and the distance between the coils change, a mutual contact may occur such that the insulation would not be ensured.

The present disclosure has been made in order to address the foregoing technical problems, and an objective is to provide a reactor in which a deformation of a resin material in a gap between partial cores is suppressed.

SUMMARY OF THE INVENTION

A reactor according to the present disclosure includes:

a core which includes at least a pair of partial cores disposed via a gap;

a coil attached to a part of the core; and a core molding member which is formed integrally by a resin material and which covers the pair of partial cores, in which:

the core molding member includes a coupling portion which is provided between the pair of partial cores at a location corresponding to the gap; and the coupling portion includes a through-hole, and a pair of connection portions which face with each other across the through-hole and which connects a space between the pair of partial cores.

According to the present disclosure, a reactor in which a deformation of a resin material in a gap between partial cores is suppressed is provided.

DETAILED DESCRIPTION OF THE EMBODIMENTS

A reactor according to an embodiment will be described with reference to the accompanying drawings. In this specification, a direction along Z-axis in FIG. 1 will be defined as an "upper" side, and the opposite side will be defined as a "lower" side. In the description of structures of each component, the "lower" side will be also referred to as a "bottom". The direction along Z-axis is a height direction of the reactor. Moreover, a direction along X-axis in FIG. 1 and an opposite direction thereto will be defined as a "widthwise direction", and a direction along Y-axis and the opposite direction thereto will be defined as a "depthwise direction". A plane defined by the "widthwise direction" and the "depthwise direction" will be defined as a "horizontal direction". Those directions are notations to describe the positional relationship among each components of the reactor, and are not intended to limit the positional relationship and the direction when the reactor is installed on an object where the reactor is to be installed.

[Structure]

Figure 1:
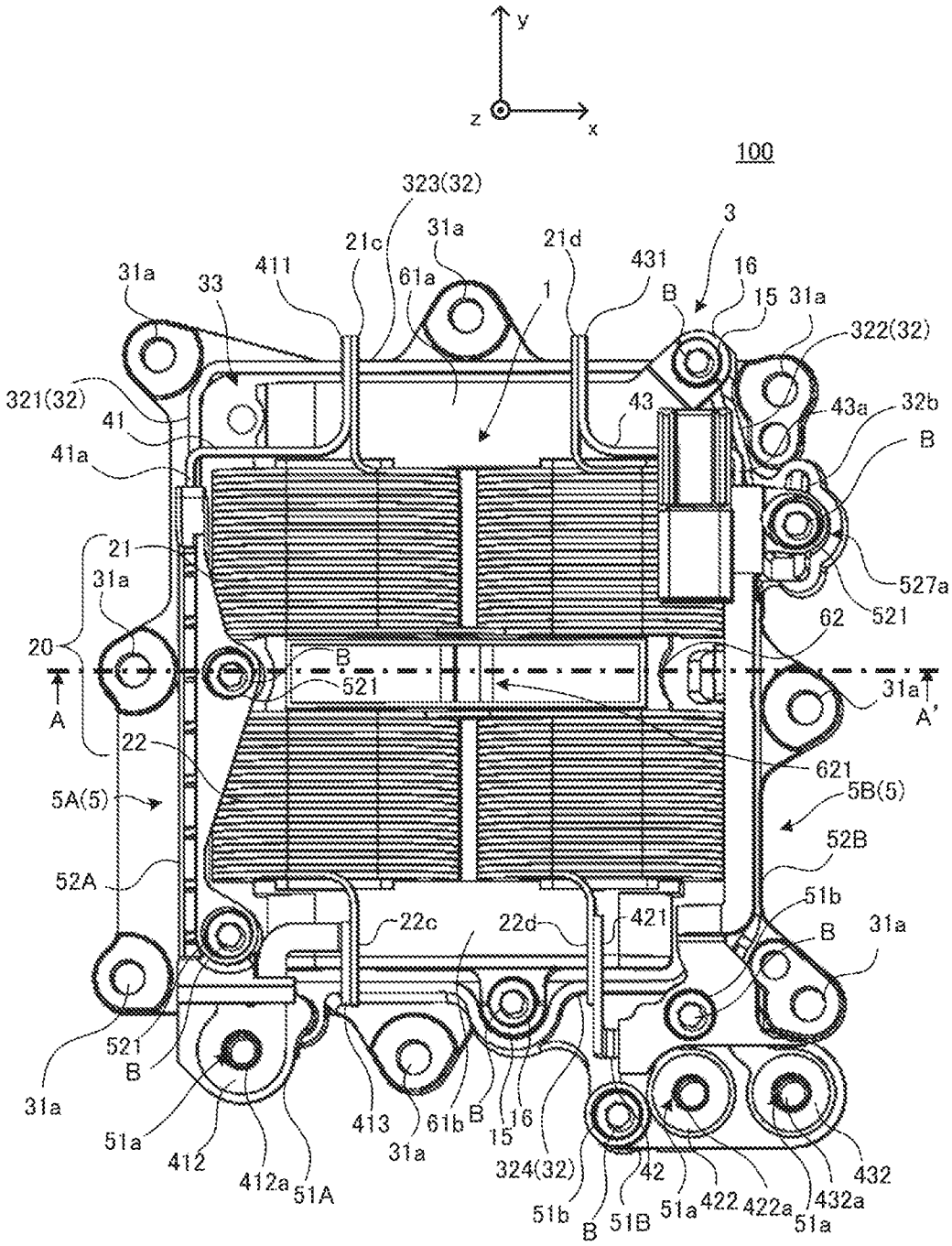
FIG. 1 is a plan view of a reactor according to an embodiment.
Figure 2:
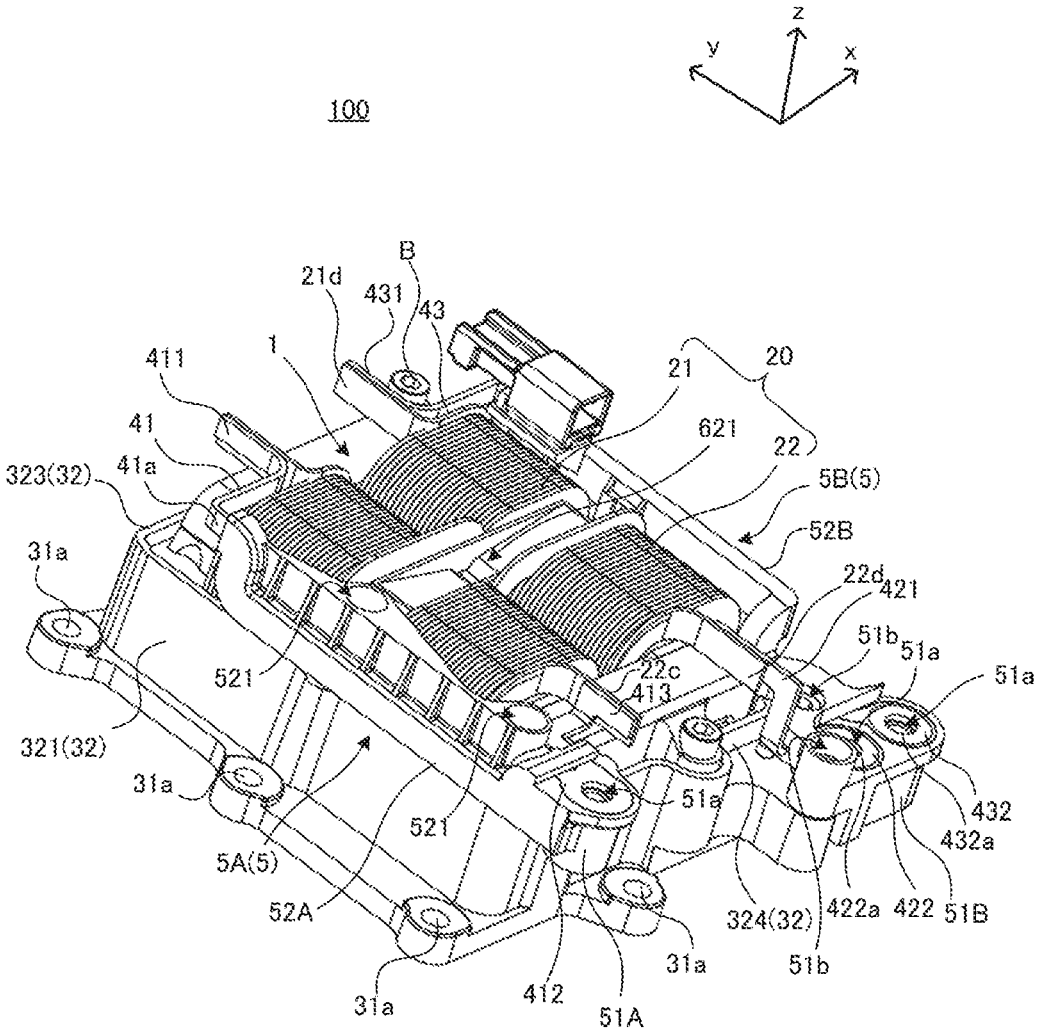
FIG. 2 is a front side perspective view of the reactor according to the embodiment.

As illustrated in a FIG. 1 that is a plan view and FIG. 2 that is a front side perspective view, a reactor 100 includes a reactor main body 1, a casing 3, a bus bar 4, and a terminal stage 5.

[Reactor Main Body]

Figure 3:
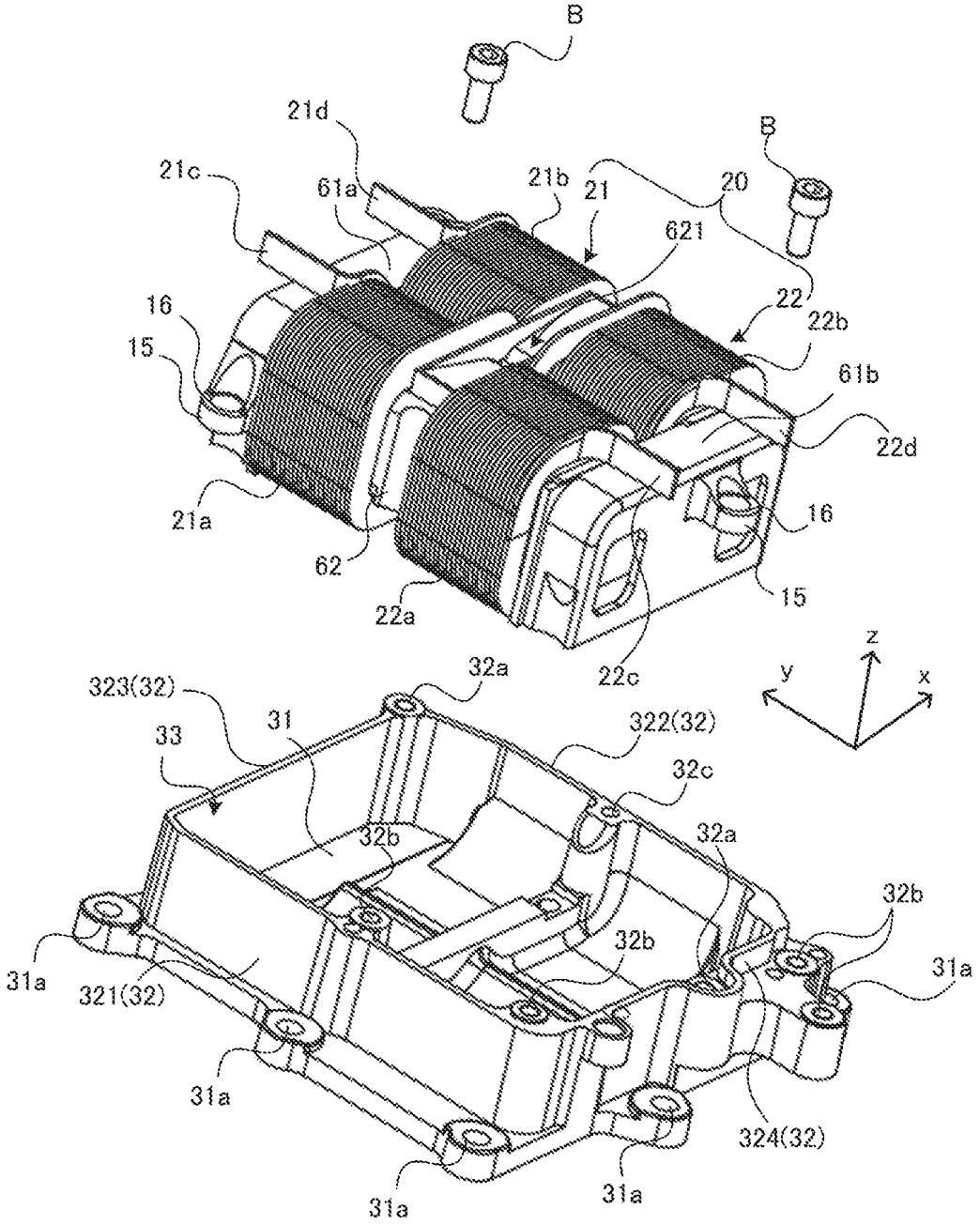
FIG. 3 is an exploded perspective view illustrating a reactor main body and a casing.
Figure 4:
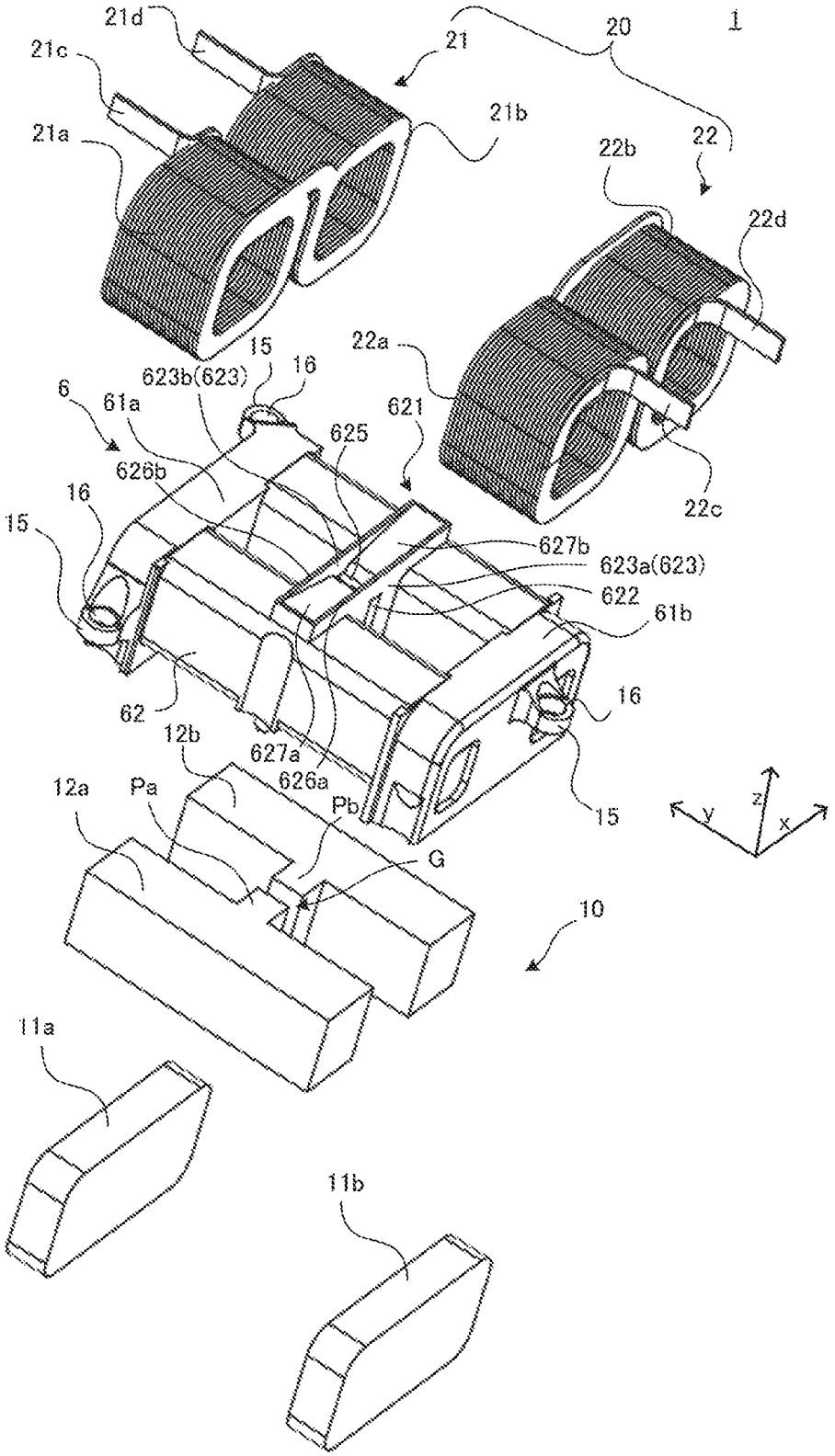
FIG. 4 is an exploded perspective view of the reactor main body.

As illustrated in FIG. 1 that is a plan view and FIG. 3 that is an exploded perspective view, the reactor main body 1 according to the present embodiment is formed in a substantially rectangular shape with rounded corners as a whole which has a pair of long sides and a pair of short sides, in a plan view. A rectangular shape with rounded corners is a rectangle which has rounded corners. As illustrated in FIG. 4 that is an exploded perspective view, the reactor main body 1 includes a core 10 and a coil 20.

[Core]

The core 10 is a magnetic substance, such as a powder magnetic core, a ferrite magnetic core, or a laminated steel plate, and the interior thereof serves as a path for magnetic fluxes produced by the coil 20 to be described later to form a magnetic circuit. The core 10 of the present embodiment includes at least a pair of partial cores disposed via a gap. More specifically, as illustrated in FIG. 4, the core 10 includes, as the partial cores, two I-shaped cores 11*a* and 11*b* and two T-shaped cores 12*a* and 12*b*. The I-shaped cores 11*a* and 11*b* are each in a substantially cuboid shape. The T-shaped cores 12*a* and 12*b* are each in a substantially T-shape by having respective center protrusions Pa and Pb formed on respective side surfaces facing each other at portions in the substantially cuboid. The core 10 forms an annular core by butting and bonding one surfaces of the I-shaped cores 11*a* and 11*b*, and both end portions of the T-shaped cores 12*a* and 12*b* via an unillustrated adhesive. More specifically, in the present embodiment, since the center protrusions Pa and Pb are located inwardly relative to the annular shape, the core is formed in a substantially θ shape as a whole.

The one surfaces of the I-shaped cores 11*a* and 11*b* and both end portions of the T-shaped cores 12*a* and 12*b* may be in direct contact and butted without an adhesive, or may have a magnetic gap therebetween. Such a magnetic gap may be formed by providing a spacer or may be formed by an air gap.

Furthermore, according to the present embodiment, a core molding member 6, which is formed of a resin material and which covers the partial cores, is provided. The core molding member 6 includes core casings 61*a*, 61*b*, and 62. The core casing 61*a* is an insulation resin mold component that houses therein the I-shaped core 11*a*. The core casing 61*b* is an insulation resin mold component that houses therein the I-shaped core 11*b*. The core casing 62 is an insulation resin mold component that houses therein the T-shaped cores 12*a* and 12*b*. The core casings 61*a*, 61*b*, and 62 are present between the core 10 and the coil 20 to ensure insulation.

The core casing 61*a* is integrally formed by filling and curing resin material with the I-shaped core 11*a* set in a mold. The core casing 61*b* is integrally formed by filling and curing resin material with the I-shaped core 11*b* set in a mold. The core casing 62 is integrally formed by filling and curing resin material with the T-shaped cores 12*a* and 12*b* set in a mold. The wordings "formed integrally" means that the partial cores are embedded in the resin material. In addition, the wordings "formed integrally" involve a case in which the plurality of partial cores is separately embedded in the resin material and then combined, and a case in which the plurality of partial cores is embedded collectively so that it is continuously formed without a seam.

However, openings are provided in the core casings 61*a* and 61*b* that cover the I-shaped cores 11*a* and 11*b*, respectively, at portions corresponding to joined surfaces of the I-shaped cores 11*a* and 11*b* relative to the T-shaped cores 12*a* and 12*b*. Openings are provided in the core casing 62 that covers the T-shaped cores 12*a* and 12*b* at portions corresponding to joined surfaces of the T-shaped cores 12*a* and 12*b* relative to the I-shaped cores 11*a* and 11*b*. Engaging portions that are to be engaged with each other when the core 10 is assembled into substantially θ shape are formed in those openings of the core casings 61*a*, 61*b*, and 62.

As illustrated in FIGS. 3 and 4, attaching portions 15 for fixing to the casing 3 are formed on the outer surfaces of these core casing 61*a* and 61*b*. The attaching portion 15 is a tabular piece protruding outwardly, and an attaching hole 16 in which a bolt B is inserted is formed. The bolt B is a fastener which has a screw. Two attaching portions 15 are formed on both ends of the I-shaped core casing 61*a*, and one attaching portion 15 is formed on the center of the I-shaped core casing 61*b*. These attaching portions 15 are formed together with the molding of the core casings 61*a* and 61*b*.

The pair of T-shaped cores 12*a* and T-shaped core 12*b* which are the partial cores are disposed via a gap G. That is, an end surface of the center protrusion Pa of the T-shaped core 12*a* and an end surface of the center protrusion Pb of the T-shaped core 12*b* face with each other via the magnetic gap G which is an air gap. The core casing 62 that is the core molding member 6 which covers the T-shaped cores 12*a* and 12*b* has a coupling portion 621 at a location corresponding to the gap G between the T-shaped cores 12*b* and 12*b*. Therefore, the core casing 62 is formed in a substantially H-shape as a whole in a planar view. Moreover, the coupling portion 621 is disposed at the inner-circumference side of the annular core 10.

Figure 5:
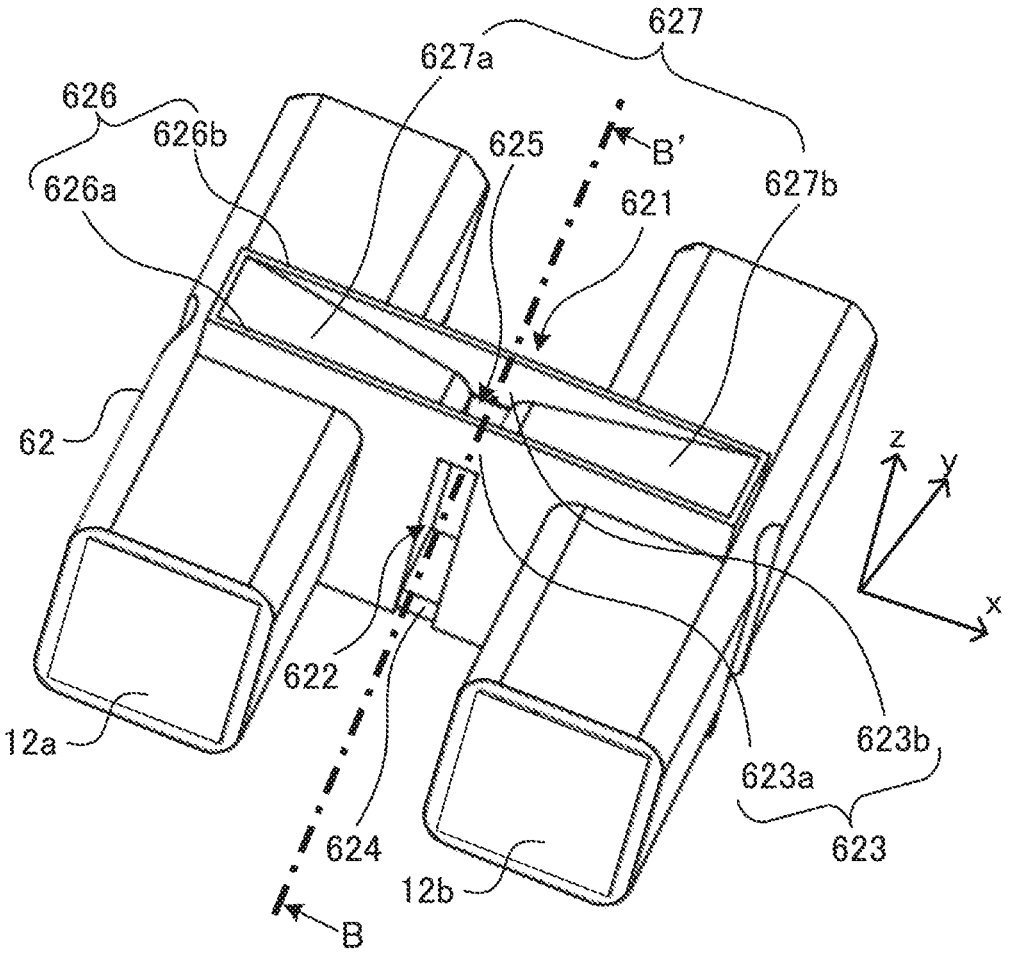
FIG. 5 is a perspective view of a core casing in which a T-shaped core is embedded.
Figure 6:
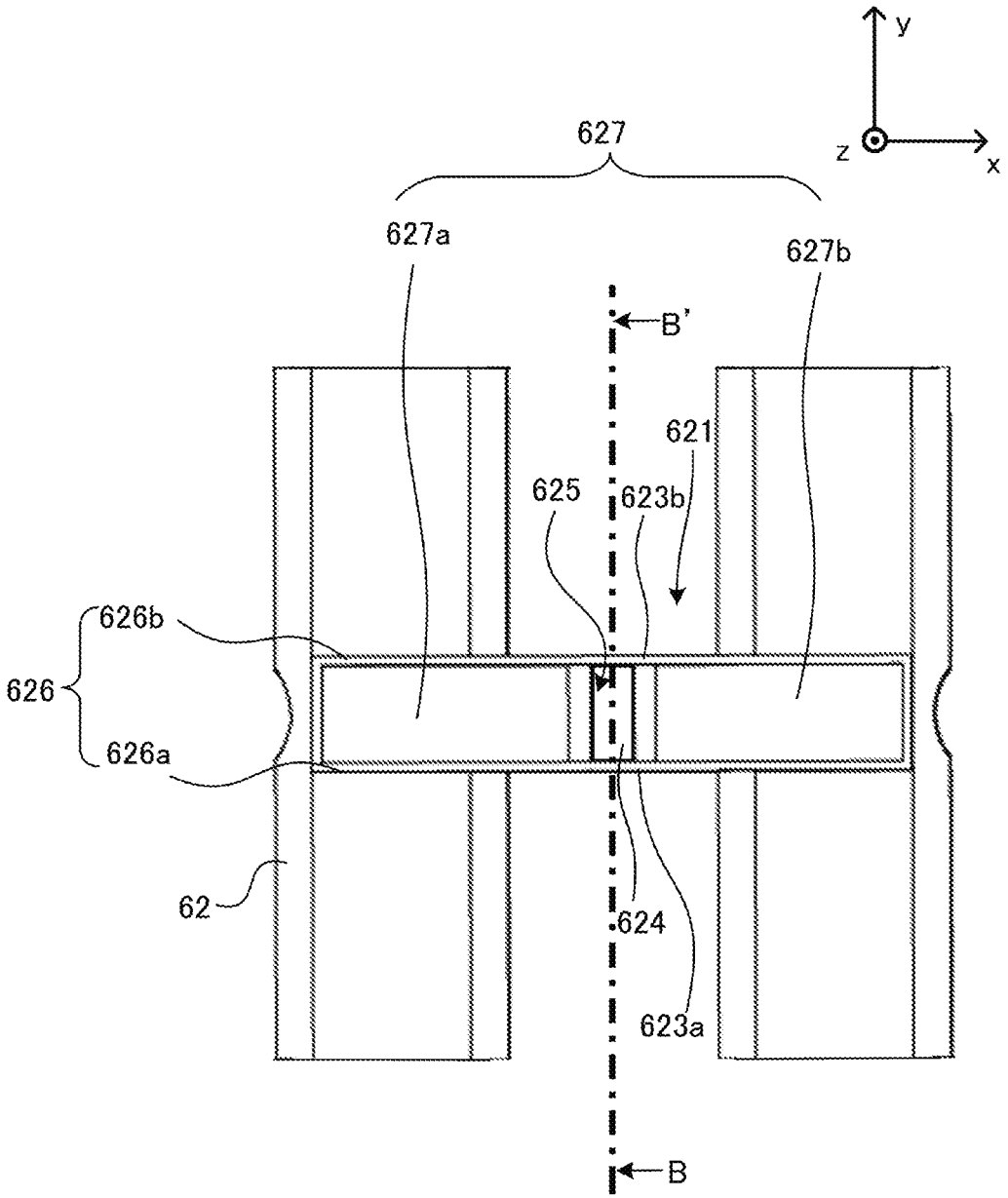
FIG. 6 is a plan view of FIG. 5.

As illustrated in FIG. 5 that is a perspective view and FIG. 6 that is a plan view, the coupling portion 621 includes a through-hole 622, and connection portions 623 and 624. The through-hole 622 is a hole penetrating in the lengthwise direction of the T-shaped cores 12*a* and 12*b*, that is, in parallel with the winding direction of the coil 20. The through-hole 622 is in a rectangular shape that has a long cross-section in the height direction.

The connection portions 623 and 624 face with each other across the through-hole 622, and connect a space between the T-shaped core 12*a* and the T-shaped core 12*b*. In the present embodiment, a direction along the x-axis direction, that is, a direction in parallel with the lengthwise direction of the I-shaped cores 11*a* and 11*b*, and a direction orthogonal to the lengthwise direction of the T-shaped cores 12*a* and 12*b* will be defined as the connection direction. It is preferable that the clearance between the edges of the connection portions 623 and 624 facing with each other, that is, a length between an upper edge of the connection portion 623 and a lower edge of the connection portion 624 in the height direction is equal to or greater than the thickness of the T-shaped cores 12*a* and 12*b* in the height direction. The connection portion 623 is bridged across the upper portions of the T-shaped core 12*a* and T-shaped core 12*b*. The connection portion 623 includes an opening 625. The opening 625 is a hole in communication with the through-hole 622. The opening 625 of the present embodiment has a rectangular shape. Therefore, by providing the opening 625 that is in communication with the through-hole 622, the connection portion 623 includes a pair of opposing connection portions 623*a* and 623*b* which face with each other via a clearance in a direction orthogonal to the connection direction, that is, a direction along the y-axis direction. The opposing connection portions 623*a* and 623*b* are each tabular, and the planar direction thereof is the height direction (a direction along the z-axis direction). That is, the connection portion 623 includes tabular portions that face with each other.

Figure 7:
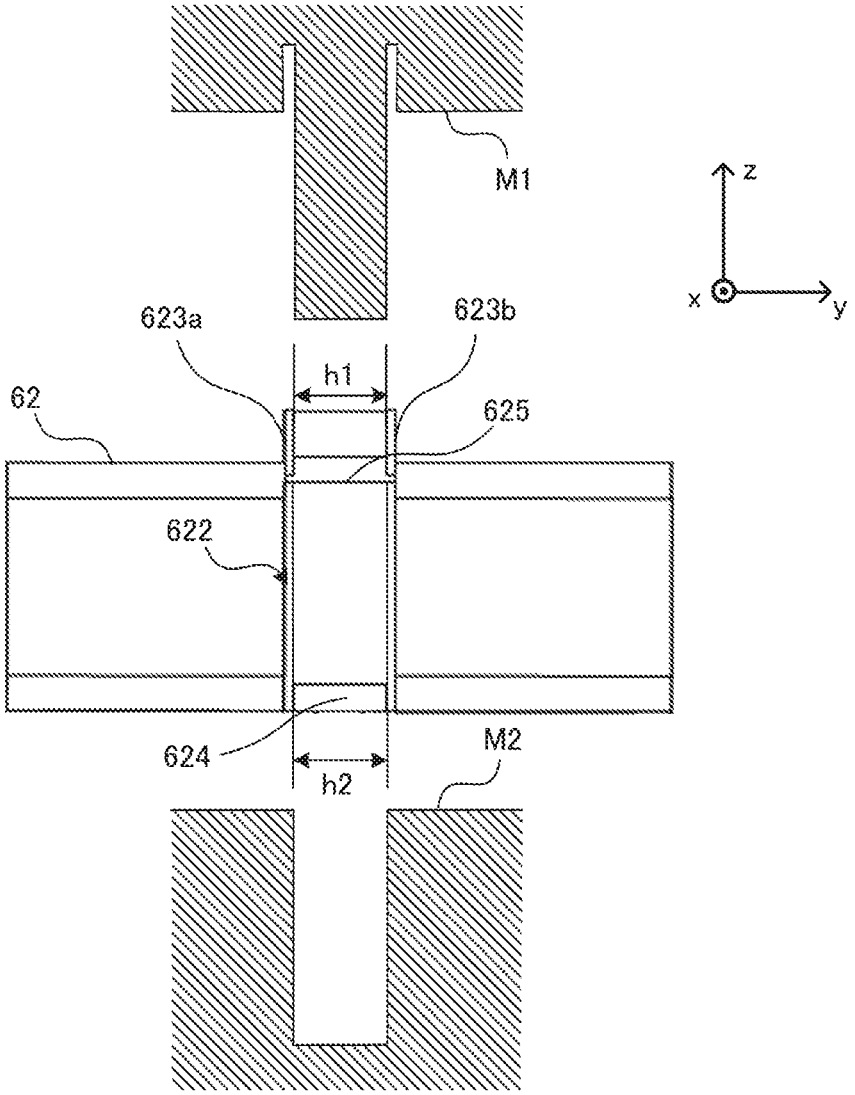
FIG. 7 is a cross-sectional view taken along a line B-B' in FIG. 5 and FIG. 6.

The connection portion 624 is bridged across the lower portions of the T-shaped core 12*a* and T-shaped core 12*b*. The connection portion 624 has a tabular portion. The tabular portion has the planar direction in the horizontal direction. That is, the connection portion 623 and the connection portion 624 have respective tabular portions that face with each other in the direction orthogonal to each other. The connection portion 624 is formed to be equal to or smaller than the width of the opening 625 at a location that face the opening 625*s*. That is, the connection portion 624 is disposed at an opposing location between the opposing connection portions 623*a* and 623*b*, and is formed with the width equal to or smaller than the clearance between the opposing connection portions 623*a* and 623*b*. The term "width" in this case is a length in the lengthwise the direction of the T-shaped cores 12*a* and 12*b*, and is different from the widthwise direction of the reactor 100 and the reactor main body 1. According to the present embodiment, as illustrated in FIG. 7 that is a cross-sectional view taken along a line B-B' in FIG. 5 and in FIG. 6, the opening 625 and the connection portion 624 located between the opposing connection portions 623*a* and 623*b* face with each other in the vertical direction across the through-hole 622, and a width h1 of the opening 625 and a width h2 of the connection portion 624 are substantially consistent with each other. Therefore, the opening 625, through-hole 622, and connection portion 624 of the coupling portion 621 can be formed by upper and lower mold M1 and M2 without applying a slide.

The core casing 62 further includes a wall portion 626 and an inclined portion 627. The wall portion 626 is a pair of walls standing upright at locations that face with each other across the opening 625. More specifically, the wall portion 626 is a pair of tabular pieces 626*a* and 626*b*, and provided in parallel with each other in the orthogonal direction to the T-shaped cores 12*a* and 12*b*.

Figure 8:
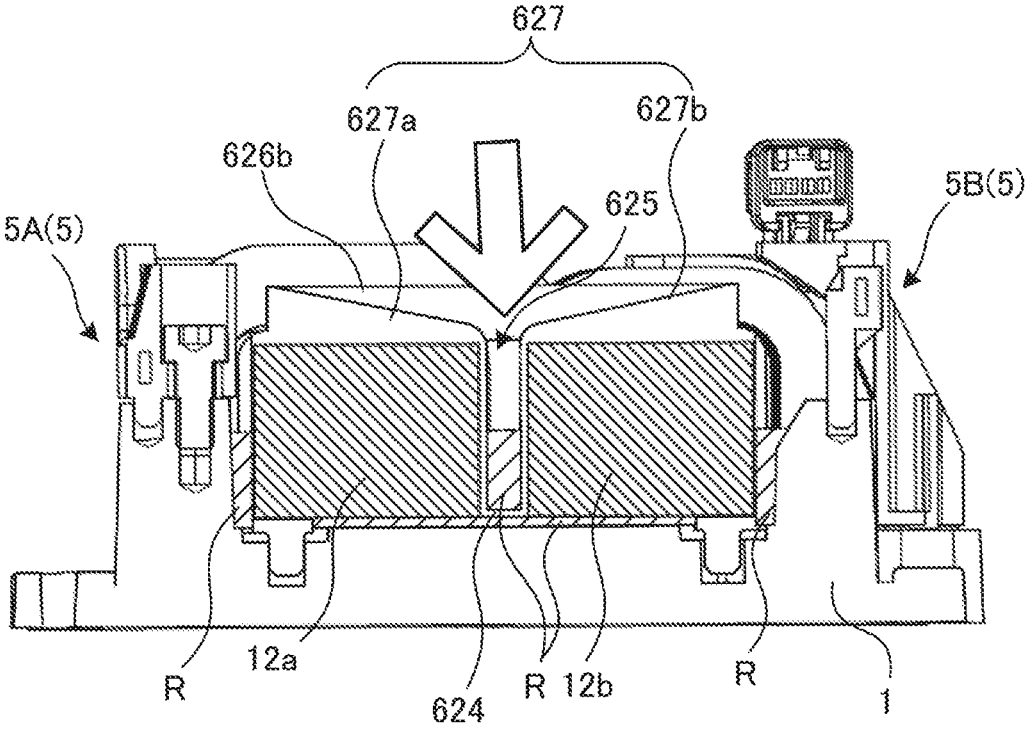
FIG. 8 is a cross-sectional view taken along a line A-A' in FIG. 1.

The inclined portion 627 is formed in such a way that the thickness of the resin material becomes thin toward the opening 625. More specifically, the inclined portion 627 has the resin material that becomes thicker as becoming a part from the opening 625, and has the resin material that becomes thinner as becoming close to the opening 625, and is an inclined surface relative to the horizontal direction. The inclined portion 627 is provided between the tabular pieces 626*a* and 626*b*, and includes a flat inclined surface 627*a* at the T-shaped-core-12*a* side, and a flat inclined surface 627*b* at the T-shaped-core-12*b* side. The tabular pieces 626*a* and 626*b* have respective portions continuous from the opposing connection portions 623*a* and 623*b*, respectively. As illustrated in FIG. 8 that is a cross-sectional view taken along a line A-A' in FIG. 1, the inclined surfaces 627*a* and 627*b* have a vertical cross-section that is in a substantially V-shape.

[Coil]

The coil 20 is a conductive member attached to the core 10. As illustrated in FIG. 4 that is an exploded perspective view, the coil 20 according to the present embodiment is an edgewise coil of a rectangular flat wire which has an insulation coating. However, the winding material of the coil 20 and the way of winding are not limited to any particular types, and other forms may be employed.

The coil 20 includes coupled coils 21 and 22. The coupled coil 21 forms a pair of partial coils 21*a* and 21*b* using a single conductor. The coupled coil 22 forms a pair of partial coils 22*a* and 22*b* using a single conductor.

The partial coils 22*a* and 22*b* are attached to the respective one ends of the T-shaped cores 12*a* and 12*b*. That is, the partial coils 22*a* and 22*b* are disposed at the I-shaped-core-11*a* side relative to the center protrusions Pa and Pb. The partial coils 22*a* and 22*b* are attached to the respective other ends of the T-shaped cores 12*a* and 12*b*. That is, the partial coils 22*a* and 22*b* are disposed at the I-shaped-core-11*b* side relative to the center protrusions Pa and Pb.

Winding start and winding termination end portions 21*c* and 21*d* of the coupled coil 21 drawn out from the wound portion and winding start and winding termination end portions 22*c* and 22*d* of the coupled coil 22 drawn out from the wound portion are respectively drawn outwardly relative to the reactor main body 1. More specifically, the end portions 21*c* and 21*d* extend along a long-side direction of the reactor main body 1, and protrude from the one short-side. The end portions 22*c* and 22*d* extend along the long-side direction of the reactor main body 1, and protrude from the other short-side.

The coupled coil 21 and the coupled coil 22 are wound in such a way that magnetic fluxes respectively produced are in opposite directions to each other. The wordings to wind in such a way that DC magnetic fluxes are in opposite directions to each other involve a case in which the winding directions are inverted but currents in the same directions are caused to flow, and also a case in which the winding direction is consistent but currents in the opposite directions are caused to flow.

[Casing]

As illustrated in FIG. 3 that is an exploded perspective view, the casing 3 houses therein the reactor main body 1, and has a portion where an opening 33 is formed. It is preferable that the casing 3 should be formed of a material which has a high thermal conductivity and which achieves a magnetic shield effect. For example, a metal, such as aluminum, magnesium or an alloy thereof is applicable. Moreover, it is not always necessary that the casing 3 is formed of a metal, and a resin that has an excellent thermal conductivity or a structure in which a metal heat dissipation plate is partially embedded in such a resin is applicable. Moreover, a magnetic substance is applicable to the entire casing 3 or a part of the casing. The magnetic substance has a higher magnetic shield effect than that of a metal like aluminum.

The casing 3 includes a support 31 and a wall 32. The support 31 is supported by an unillustrated installation surface. In the present embodiment, the support 31 is a flat-plate member in a substantially rectangular shape. Concavities and convexities along the reactor main body 1 are formed in the surface of the support 31 at a side where the reactor main body 1 is housed. However, a clearance is provided between the reactor main body 1 and the support 31. Moreover, fastening holes 31*a* for fastening to the installation surface are formed in the four corners of the support 31 and near respective centers of the long sides thereof.

The wall 32 is provided on the support 31 so as to stand upright, and surrounds the circumference of the reactor main body 1. The wall 32 forms the opening 33 at the opposite side to the support 31. More specifically, the wall 32 includes a pair of side walls 321 and 322 in the long-side direction of the reactor main body 1, and a pair of side walls 323 and 324 in the short-side direction. The space surrounded by the surfaces of the support 31 and of the wall 32 facing the reactor main body 1 becomes a housing space for the reactor main body 1.

The opening 33 is an opened portion formed in the wall 32 at the opposite side to the support 31. In the present embodiment, the upper portion of the casing 3 is opened by the opening 33, and apart of the reactor main body 1 protrudes from the casing 3 via such an opening. That is, since the upper edge of the wall 32 is lower than the height of the core 10, with the reactor main body 1 being housed, the respective upper portions of the coil 20 and core casings 61*a*, 61*b*, and 62 protrude from the opening 33. In the present embodiment, the upper half of the reactor main body 1 protrudes from the edge of the opening 33.

The three attachment holes 32*a* are formed in the wall 32 at positions corresponding to the attaching holes 16 of the core casings 61*a* and 61*b*. A screw thread is cut in these attachment holes 32*a*. Formed between the reactor main body 1 and the support 31 of the casing 3 is the space as described above. Moreover, in order to attach the terminal stage 5, attachment holes 32*b* and a pin hole 32*c* are provided in the casing 3. A screw thread is cut in the attachment holes 32*b*.

[Bus Bar]

The bus bar 4 is a conductive body electrically connected to the coil 20. The bus bar 4 is provided between the coil 20 and an unillustrated external device like an external power supply, and electrically connects both to each other. The bus bar 4 is a thin elongated bandlike body, and example materials thereof are copper, aluminum, etc.

In the embodiment, as illustrated in FIGS. 1 and 2, three bus bars 41, 42, and 43 are adopted. The bus bars 41 and 43 include respective body portions 41*a* and 43*a* in a bandlike shape along the edge of the opening 33 of the casing 3, i.e., the upper edges of the side walls 321 and 322. One end of the bus bar 41 is a connection portion 411 connected to the end portion 21*c* of the coupled coil 21 where the insulation coating is peed by, for example, welding. The other end of the bus bar 41 is branched into two pieces. One branched end is a terminal 412 for connection to an external device. A terminal hole 412*a* is formed in the terminal 412. The other branched end is a connection portion 413 connected to the end portion 22*c* of the coupled coil 22 where the insulation coating is peeled by, for example, welding. Hence, the terminal 412 forms a common input terminal for the coupled coils 21 and 22.

One end of the bus bar 42 is a connection portion 421 connected to the end portion 22*d* of the coupled coil 22 where the insulation coating is peeled by, for example, welding. The other end of the bus bar 42 is a terminal 422 for connection to an external device. A terminal hole 422*a* is formed in the terminal 422.

One end of the bus bar 43 is a connection portion 431 connected to the end portion 21*d* of the coupled coil 21 where the insulation coating is peeled by, for example, welding. The other end of the bus bar 43 is a terminal 432 for connection to an external device. A terminal hole 432*a* is formed in the terminal 432.

[Terminal Stage]

As illustrated in FIG. 1, the terminal stage 5 is a body that supports electric connection portion between the bus bar 4 and the exterior. In the present embodiment, a terminal stage 5A and a terminal stage 5B are provided separately and corresponding to the side faces of the casing 3 that face with each other.

The terminal stages 5A and 5B are entirely formed of a resin material. The terminal stages 5A and 5B include stage portions 51A and 51B and extended portions 52A and 52B, respectively. That is, the terminal stage 5A is formed of a resin material integrally so as to include the stage portion 51A and the extended portion 52A, and the terminal stage 5B is formed of a resin material integrally so as to include the stage portion 52B and the extended portion 52B. The wordings formed integrally involve a case in which both portions are formed separately and then joined together, and a case in which those portions are continuously formed without a seam.

An example resin material applied to form the terminal stages 5A and 5B is an insulation material. For example, polyphenylene sulfide (PPS), an unsaturated polyester-based resin, an urethane resin, an epoxy resin, bulk molding compound (BMP), and polybutylene terephthalate (PBT), etc., are applicable as the resin material.

The stage portions 51A and 51B support the respective terminals 412, 422 and 432 of the bus bars 41, 42 and 43. Terminal holes 51*a* corresponding to the respective terminal holes 412*a*, 422*a* and 432*a* of the terminals 412, 422 and 432 are formed in the stage portions 51A and 51B. Although it is not illustrated, a nut is embedded in the lower portion of the terminal hole 51*a* so as to be coaxial with the terminal hole 51*a*. Moreover, attaching holes 51*b* are provided in the stage portion 51B at locations corresponding to the attachment holes 32*b* of the casing 3. Furthermore, a space between the connection portion 421 of the bus bar 42 and the terminal 422 is embedded in the stage portion 51B.

The extended portions 52A and 52B are each a member in which a part of the body portion 41*a* and 43*a* of the bus bar 41 and 43 is embedded and which is provided along the edge of the opening 33. The extended portions 52A and 52B according to the present embodiment are mounted at the opposite side of the wall 32 to the support 31 so as to be extended above the wall 32. The extended portion 52A is extended along the upper edge of the side wall 321 from the side wall 324 at the one short-side of the casing 3. The extended portion 52B is extended along the upper edge of the side wall 322 from the side wall 324 at the one short-side of the casing 3. Attaching holes 521 are formed in the above described extended portions 52A and 52B at locations corresponding the plurality of attachment holes 32*b* of the casing 3.

[Placement of Reactor Main Body in Casing and Filling by Filler]

The reactor main body 1 employs the structure as follows by combining the core 10 and the coil 20. That is, the T-shaped cores 12*a* and 12*b* embedded in the core casing 62 are fitted in the coupled coils 21 and 22 that have been wound beforehand, and the joined surfaces of the T-shaped cores 12*a* and 12*b*, and the joined surfaces of the I-shaped cores 11*a* and 11*b* embedded in the core casings 61*a* and 61*b* are respectively bonded by an adhesive. Moreover, the engaging portions of the core casings 61*a*, 61*b*, and 62 are engaged with each other.

Such a reactor main body 1 is fastened to the casing 3 by aligning the respective attaching holes 16 of the core casings 61*a* and 61*b* to the respective attachment holes 32*a* of the casing 3 and inserting and tightening the respective bolts B. The coil 20 of the reactor main body 1 housed in the casing 3 has the winding axial direction of the wound portion disposed in parallel with the edge of the opening 33 of the casing 3, i.e., the wall 32. According to the present embodiment, such a winding axial direction is disposed in parallel with the side walls 321 and 322 in the long-side direction of the reactor main body 1.

The terminal stages 5A and 5B are mounted on the casing 3 in such a way that the attaching holes 51*b* and 521 is aligned with the attachment hole 32 of the casing 3. Moreover, by inserting and tightening the respective bolts B in the attaching holes 51*b* and 521, the terminal stages 5A and 5B are fastened to the casing 3. The terminal stage 5B is mounted on the casing 3 so as to allow an unillustrated pin to be inserted in the pin hole 32*c* of the casing 3. Furthermore, the connection portion 421 of the bus bar 42 is connected to the end portion 22*d* of the coupled coil 22, and the connection portion 431 of the bus bar 42 is connected to the end portion 21*d* of the coupled coil 21.

A filler is filled in the internal space of the casing 3 where the reactor main body 1 is retained, and is cured. That is, as illustrated in FIG. 8 that is a cross-sectional view taken along the line A-A' in FIG. 1, a filler molded portion R formed by the cured filler is provided in the clearance filler molded portion R between the casing 3 and the reactor main body 1. An example filler is a resin which is relatively soft and which has a high thermal conductivity in view of the ensured heat dissipation performance of the reactor main body 1 and the reduction of vibration transmission to the casing 3 from the reactor main body 1.

As indicated by a white arrow in FIG. 8, the filler is dropped into the opening 625 provided in the connection portion 623 of the core casing 62, thus flowing into the casing 3. At this time, the wall portion 626 prevents the filler from flowing out to the upper portion of the coil 20. Moreover, the inclined portion 627 causes the filler to flow toward the opening 625 by the own weight. Furthermore, the filler flowing down from the opening 625 is caused, by the through-hole 622, to flow out to the bottom surface of the casing 3 and spreads under the coil 20, the core casing 62, and further the core casings 61*a* and 61*b*.

[Action and Effect]

(1) A reactor includes: a core 10 that includes the T-shaped cores 12*a* and 12B which are at least a pair of partial cores disposed via the gap G therebetween; the coil 20 attached to a part of the core 10; and the core casing 62 that is the core molding member 6 which is formed integrally by a resin material and which covers the T-shaped cores 12*a* and 12*b*. The core casing 62 includes the coupling portion 621 that is provided between the T-shaped cores 12*a* and 12*b* at a location corresponding to the gap G, and the coupling portion 621 is provided with the through-hole 622, and the pair of connection portions 624 which face with each other across the through-hole 622 and which connects a space between the T-shaped cores 12*a* and 12*b*.

As described above, according to the present embodiment, since the T-shaped cores 12*a* and 12*b* are collectively molded and formed as a single component, the number of steps of assembling can be reduced. Moreover, the core casing 62 integrally formed by the resin material is not thickened since a cavity by the through-hole 622 is formed at the gap G between the T-shaped cores 12*a* and 12*b*. This suppresses a sink mark due to shrinkage when the resin material becomes a low temperature from a high temperature, and thus positional displacements of the T-shaped cores 12*a* and 12*b* are prevented. The pair of connection portions 624 across the through-hole 622 increases the rigidity in comparison with a single and thin connection portion, thereby suppressing a deformation.

Figure 9:
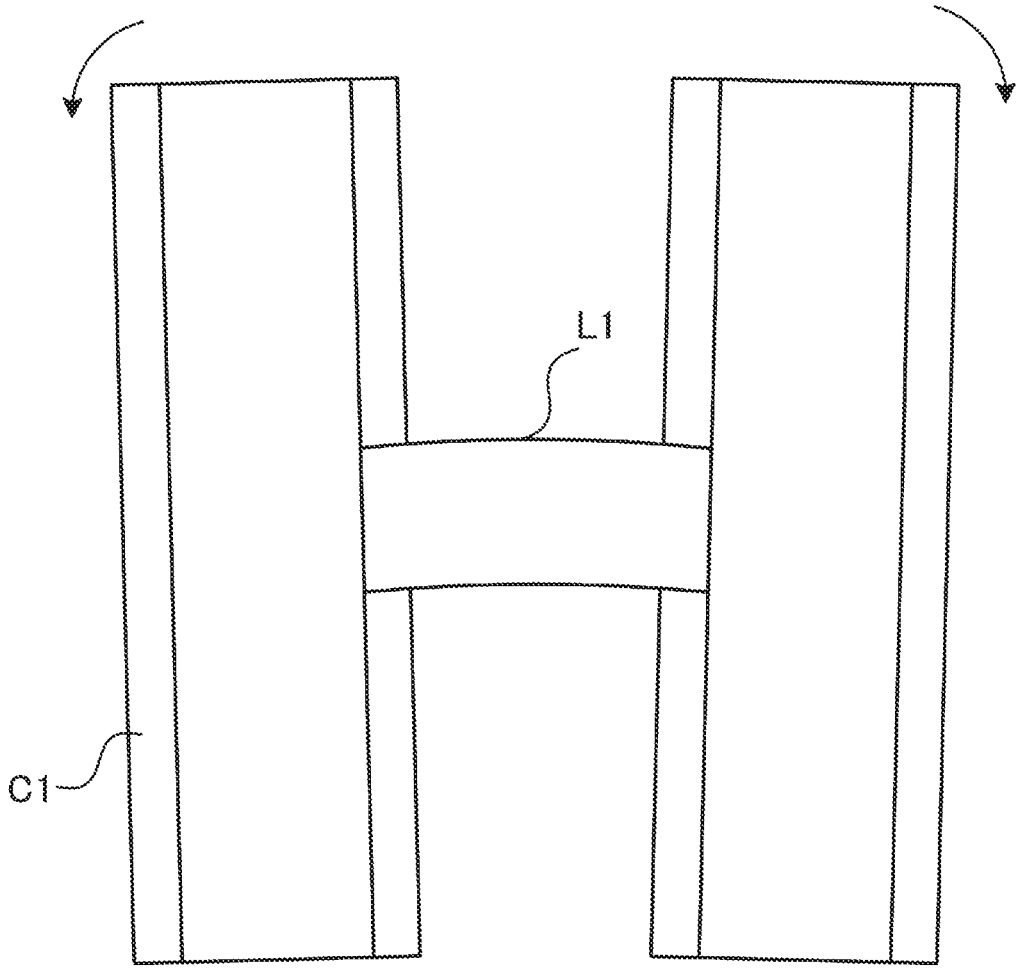
FIG. 9 is a plan view illustrating an example core casing that includes a thick coupling portion.
Figure 10:
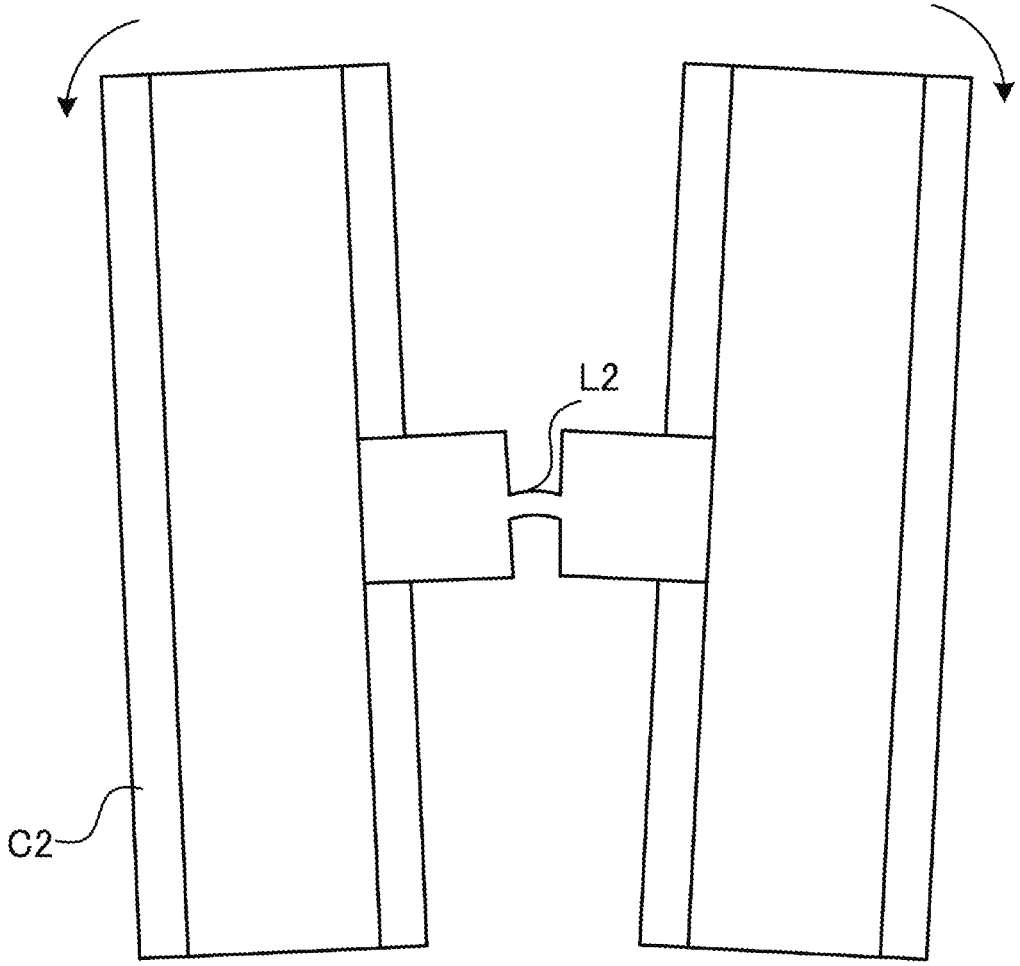
FIG. 10 is a plan view illustrating an example core casing that includes a thin coupling portion.

For example, as illustrated in FIG. 9, if a coupling portion L1 of a core casing C1 is filled by a resin material and thickened, a deformation is likely to occur by a sink mark. Moreover, as illustrated in FIG. 10, if a coupling portion L2 of a core casing C2 is thinned, since the rigidity is insufficient, a deformation is likely to occur. When a deformation of the coupling portion L1 and L2 occurs, since the positions of the cores embedded in the core casings C1 and C2 change, the insulation is not secured in some cases since the coils wound around the displaced cores contact with each other and the coil and the casing becomes in contact with each other, etc. According to the present embodiment, as described above, a deformation of the coupling portion 621 is suppressed, the insulation is ensured.

(2) The core 10 is annular, and the coupling portion 621 is disposed at the inner-circumference side of the annular core 10. Hence, although an adverse effect of positional displacements of the core 10 and the coil 20 due to a deformation of the coupling portion 621 may applied to the entire structure, according to the present embodiment, such a deformation is suppressed, and thus such an adverse effect is prevented. For example, in the above described structure, the core molding member 6 that covers the I-shaped cores 11*a* and 11*b* and the T-shaped cores 12*a* and 12*b* is annular as a whole, and is in a substantially θ shape having the coupling portion 621 provided at the center. For this reason, since an adverse effect of a positional displacement of the core 10 and the coil 20 due to a deformation of the coupling portion 621 is applied to various portions, it is advantageous to prevent such an adverse effect. For example, due to a deformation of the coupling portion 621, the I-shaped cores 11*a* and 11*b* and the T-shaped cores 12*a* and 12*b* are not joined plane by plane, and the bonding strength becomes insufficient. Moreover, bonding in an inclined direction causes unintended gap, decreasing the characteristics like magnetism. According to the present embodiment, such insufficient bonding strength and a decrease in characteristics can be prevented.

(3) The reactor includes: the casing 3 that houses therein the reactor main body 1 which includes the core 10, the coil 20, and the core molding member 6; and the filler molded portion R formed of a filler provided between the reactor main body 1 and the casing 3. One of the pair of connection portions 624 is provided with the opening 625 in communication with the through-hole 622. Hence, when the filler is applied from the opening 625, the filler spreads well in the interior of the casing 3 via the through-hole 622, achieving a uniform filling and a filling without a pore. Note that the location where the filler is applied is not limited to the opening 625. The filler may be also applied from a space between the inner circumference wall of the casing 3 and the circumference of the reactor main body 1. However, application of the filler only from the circumference of the reactor main body 1 is not likely to cause the filler to go around the center, a further application of the filler from the opening 625 is effective.

(4) The core casing 62 includes the wall portion 626 that includes pieces standing upright at the location facing with each other across the opening 625. This prevents the filler from flowing out to the upper portion of the coil 20.

(5) The core casing 62 includes the inclined portion 627 formed of a resin material that becomes thin toward the opening 625. This facilitates the filler to flow toward the opening 625.

(6) One of the pair of connection portions 623 includes the pair of opposing connection portions 623*a* and 623*b* which face with each other via a clearance in the orthogonal direction to the connection direction. Accordingly, the pair of opposing connection portions 623*a* and 623*b*, and the other connection portion 623 establish at least three connection locations, achieving a firm fastening. According to the present embodiment, a firm fastening in the direction along y-axis direction and in the direction along z-axis direction is enabled.

(7) The other one of the pair of connection portions 623 is disposed between the opposing connection portions 623*a* and 623*b* so as to face with each other, and is formed by a width that is equal to or smaller than the clearance between the opposing connection portions 623*a* and 623*b*. This enables formation of the core casing 62 by the upper and lower molds M1 and M2 (see FIG. 7) without using a slide, and thus the number of steps of production and the costs thereof can be reduced.

(8) The pair of connection portions 623 includes the respective tabular portions in the direction orthogonal to each other. This suppresses a deformation in multiple directions, achieving a further firm fastening.

OTHER EMBODIMENTS

The present disclosure is not limited to the above described embodiment, and involves other embodiments indicated below. Moreover, the present disclosure also involves a form that combines the above described embodiment with all of or some of the other embodiments to be described below. Furthermore, various omissions, replacements and modifications can be made to the embodiments without departing from the scope of the present disclosure, and such modified examples are also within the scope of the present disclosure.

Figure 11:
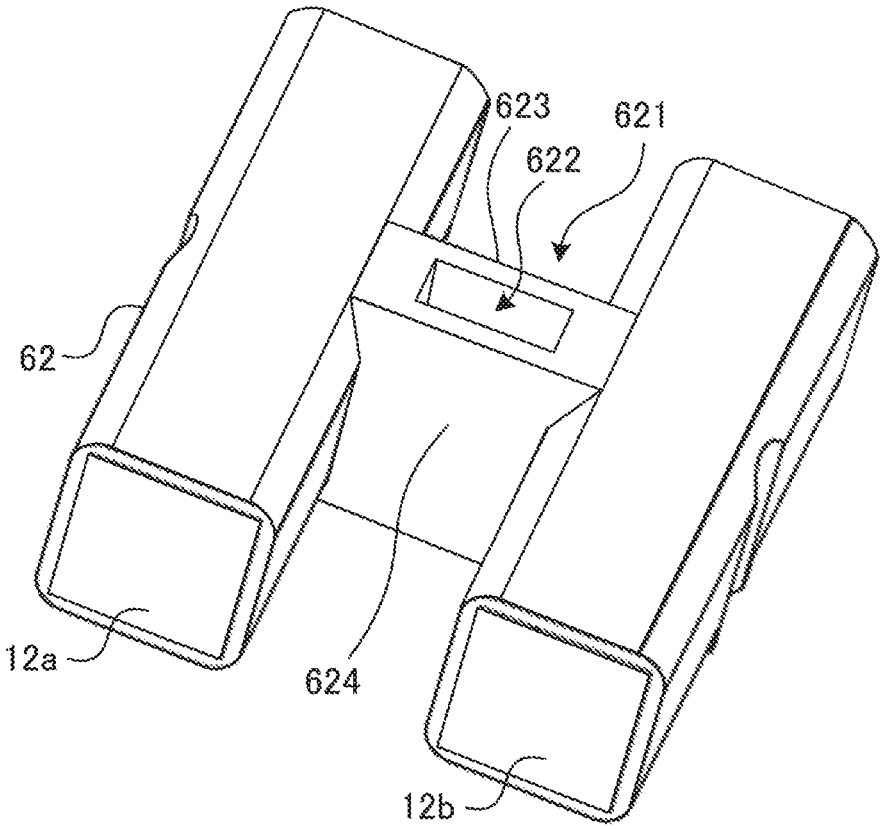
FIG. 11 is a perspective view illustrating another aspect of the coupling portion.

(1) The form of the through-hole 622 formed in the coupling portion 621 is not limited to the above described form. For example, as illustrated in FIG. 11, the through-hole may pass completely through in the lengthwise direction of the T-shaped cores 12*a* and 12*b*, i.e., the orthogonal direction to the winding direction of the coil 20. In this case, the filler can be applied from the upper opening of the coupling portion 621. Moreover, the plurality of through-holes 622 may be provided.

Figure 12:
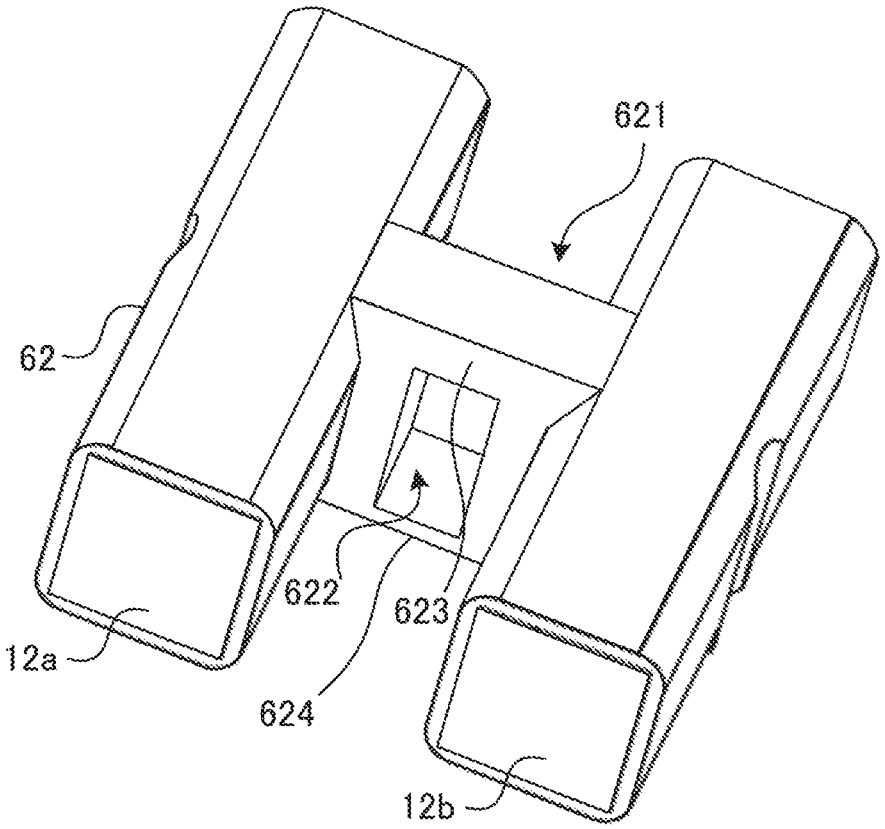
FIG. 12 is a perspective view illustrating another aspect of the coupling portion.

(2) The opening 625 may be omitted. For example, as illustrated in FIG. 12, only the through-hole 622 may be formed which passes completely through in the lengthwise direction of the T-shaped cores 12*a* and 12*b*, i.e., the winding axis direction of the coil 20, and the connection portions 623 and 624 that face with each other across the through-hole 622 may be provided.

Figure 13A:
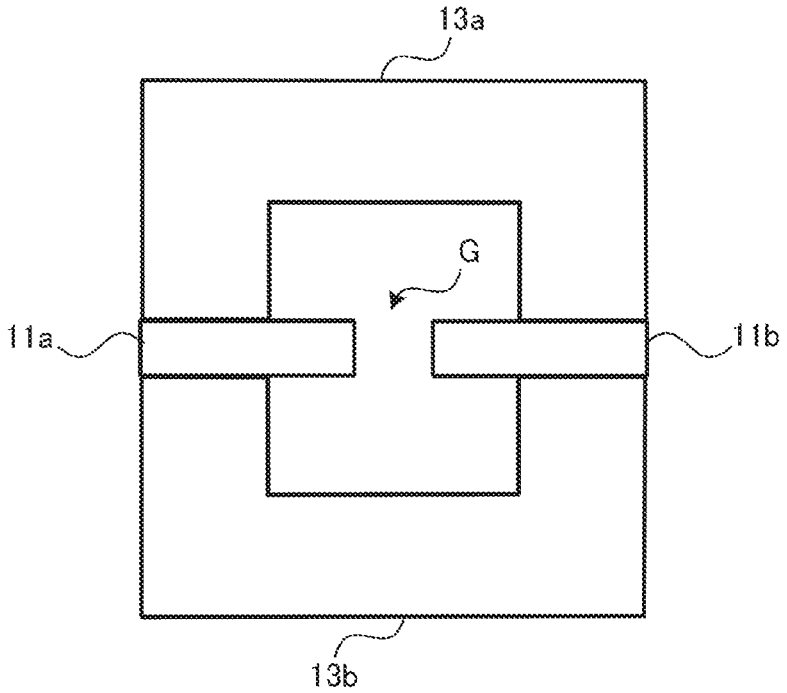
FIGS. 13A and 13B are each a plan view illustrating another example structure of the core.
Figure 13B:
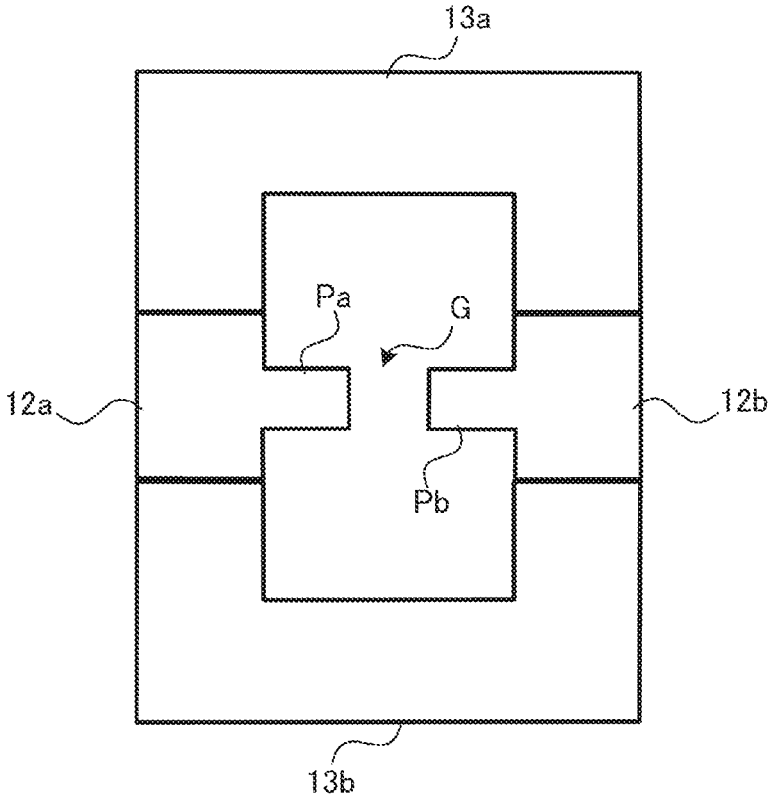

(3) The shapes, numbers, etc., of the core 10 of the main reactor main body 1, and the coil 20 thereof, are not limited to the above examples. It is appropriate if the gap G is provided between the partial cores that form the core 10, and at least one coil 20 is provided. The shape of the partial core that forms the core 10 is not limited to the above example. For example, as illustrated in FIG. 13A, the pair of I-shaped cores 11*a* and 11*b* may be held between a pair of C-shaped cores 13*a* and 13*b*, and the gap G may be formed between the I-shaped cores 11*a* and 11*b*. Moreover, as illustrated in FIG. 13B, the pair of T-shaped cores 12*a* and 12*b* may be held between the pair of C-shaped cores 13*a* and 13*b*, and the gap G may be formed between the respective center protrusions Pa and Pb of the T-shaped cores 12*a* and 12*b*. That is, regarding the partial core, any of the I-shaped cores 11*a* and 11*b*, the T-shaped cores 12*a* and 12*b*, and the C-shaped cores 13*a* and 13*b* may be combined, and the core molding member that includes the coupling portion that couples any partial cores via the gap G may be formed. Moreover, the coil 20 may employ a structure that is formed by a pair of coils 21 and 22 with a simple winding scheme. Furthermore, the coil 20 may be formed as a single coil with a single winding scheme.

(4) An enlarged portion which the cross-sectional area of the cross-sectional shape of the through hole may be provided to one of the end portion of the above through-holes. For example, a reactor according to an aspect of an embodiment may include a core which includes at least a pair of partial cores disposed via a gap, a coil attached to a part of the core, and a core molding member which is formed integrally by a resin material and which covers the pair of partial cores, in which the core molding member includes a coupling portion which is provided between the pair of partial cores at a location corresponding to the gap, the coupling portion includes a through-hole, and a pair of connection portions which face with each other across the through-hole and which connects a space between the pair of partial cores, the reactor further includes a housing which houses therein the reactor main body having core, the coil, and the core molding member, and a filler molded portion formed of a filler provided between the reactor main body and the housing, and an enlarged portion which the cross-section of the cross-sectional shape of the through-hole may be provided to one of the end portion of the through-holes. One of the pair of connection portion may also have an opening in communication with the through-hole. Furthermore, the core molding member may include a wall portion standing upright at a location facing with each other across the opening. In addition, the core molding member may include an inclined portion formed of a resin material that becomes thin toward the opening. Moreover, one of the pair of connection portion may include a pair of opposing connection portions which face with each other via a clearance in a direction orthogonal to the connection direction. The other of the pair of connection portion may be disposed at an opposing location between the opposing connection portions, and may be formed with the width equal to or smaller than the clearance between the opposing connection portions. The pair of connection portion may include a tabular portion in the direction orthogonal to each other.

Figure 14:
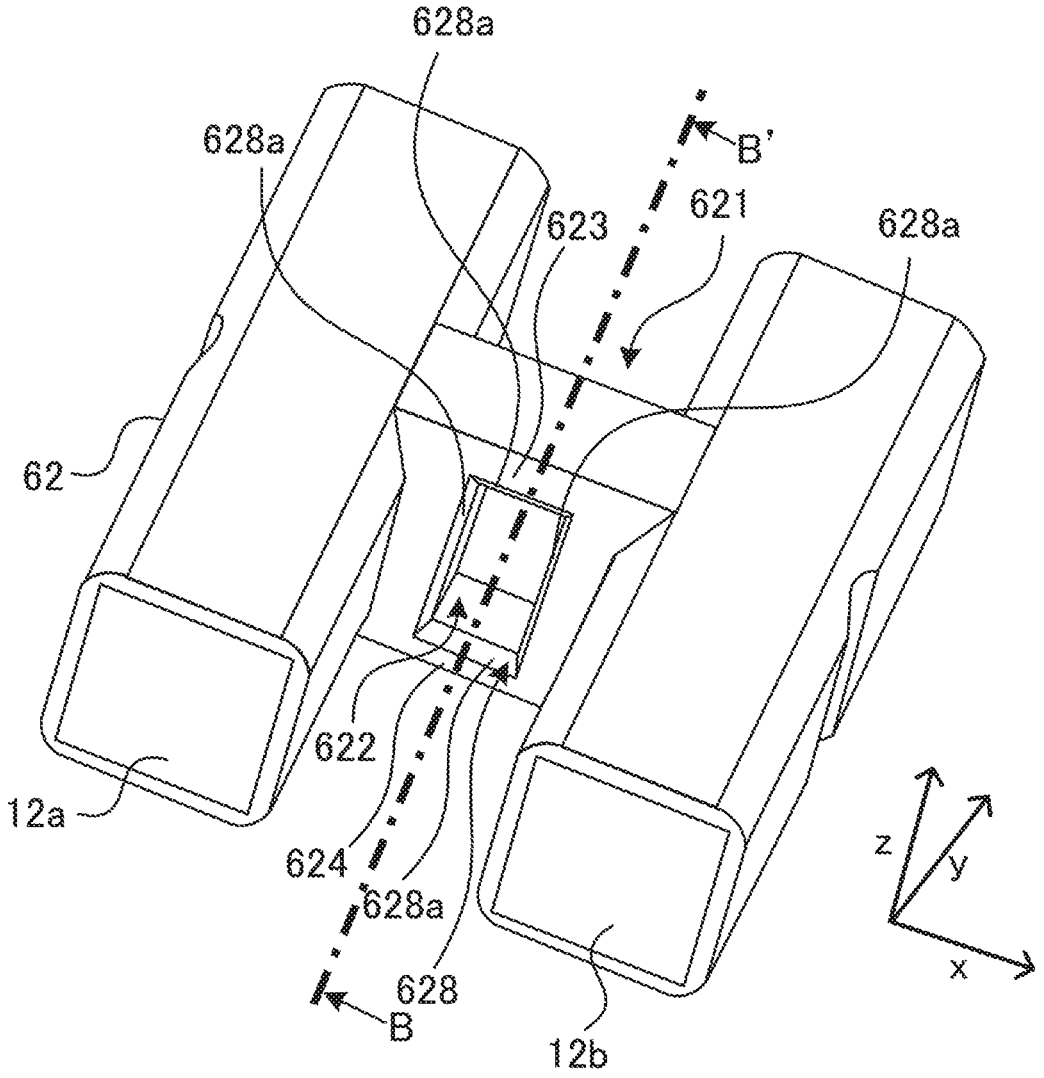
FIG. 14 is an exploded perspective view illustrating an example in which one end portion of the through-hole is enlarged.
Figure 15A:
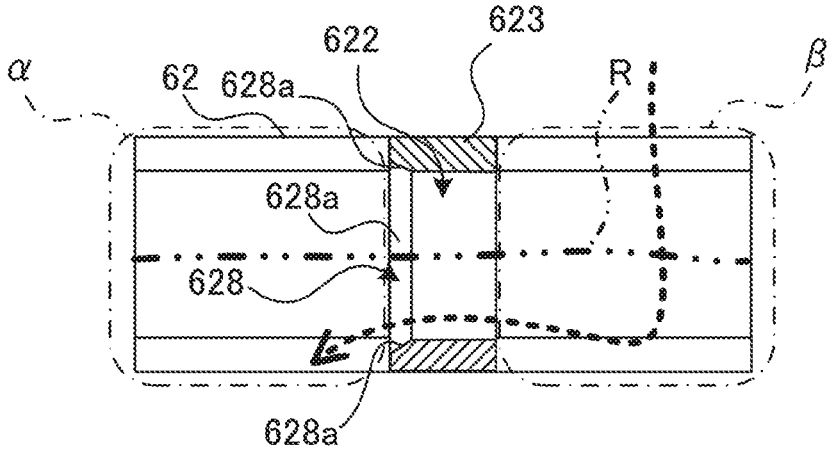
FIG. 15(A) is a cross-sectional view taken along a line B-B' in FIG. 14 in which one end of the through-hole is enlarged.

That is, as illustrated in FIG. 14 and FIG. 15 which is a cross-sectional view taken along a line B-B' in FIG. 14, an enlarged portion 628, in which the cross-sectional area orthogonal to the axis in parallel with the winding direction is enlarged toward one of the end portion from the inner side of the coupling portion 621, is provided to the through-hole 622. In detail, the enlarged portion 628 is formed by an inclined surface 628*a* which is provided continuously at the inner surface in parallel with the axis of the through-hole 622 and which is inclined relative to the axis of the through-hole 622. This inclined surface 628*a* is provided across the whole circumference of one of the end portion of the through holes 622. Accordingly, as indicated by a dotted arrow in FIG. 15(A), in both end portion of the through-hole 622, the filler that has flown in from the other end portion may easily flow out via larger one of the end portions. Note that the end portion of the through-hole 622 is the end portion corresponding to two facing side surface of the coupling portion 621, and is the end portion toward two regions divided by the coupling portion 621.

Here, in the casing which houses therein the reactor main body, heat-dissipation effect is improved because heat from the reactor main body is transferred to the casing via the filler. To achieve such heat-dissipation effect, it is preferable that the filler is uniformly filled between the reactor main body and the casing. Then, when the resin material is present in the magnetic gap between the partial cores, since the region between the partial cores is divided into a plurality of regions by the resin material, the filler have to be dropped to each of the plurality of regions. However, if the conductor of the coil, or other members are located in the position that covers any of the regions, the filler cannot be dropped to said region. Furthermore, when dropping the filler to each of the plurality of regions, the nozzle of the filling apparatus needs to be increased, or the process of moving common nozzle needs to be increased. To address this, the through-hole may be provided to the resin material so that the filler can flow between the plurality of regions, however, even in this case, the filler may not be uniform among each regions due to the insufficient flowing.

In detail, since the coupling portion 621 is present in the region between the T-shaped cores 12*a* and 12*b* that are the pair of partial cores, to completely fill the filler, the filler have to be dropped to two regions divided by the coupling portion 621. In the below description, one region of two regions is referred to as the first region α and the other of two regions is referred to as the second region β. However, since the conductor of the coil 20, or other members are overlapped in the position that covers either one of the first region α and the second region R, there is a case in which the filler can be dropped only from one of regions. Furthermore, there is a case in which it is hard to provide the opening 625 for flowing in the filler to the coupling portion 621 due to the position where the members are located. In addition, even in a case there is no restriction due to the dropping position, it is required to prepare a plurality of nozzles or to move one nozzle to a plurality of dropping positions.

In the present aspect, as described above, the problem that it is hard to completely fill the filler to the plurality of regions can be addressed. That is, in the present aspect, region between the pair of partial cores is divided into the first region α and the second region β by the coupling portion 621, and the enlarged portion is provided to the first region α corresponding to the through-hole 622. Accordingly, the filler dropped from the second region β flows into the first region α from the second region β via the through-hole 622, and since the enlarged portion 628 is provided on the first region α side of the through-hole 622 so that the cross-section of opening becomes large, the filler can easily flow into the first region α. Therefore, the filler can be completely filled not only in one region divided by the coupling portion 621, but also to the other region. Furthermore, since variation in height of the filler molded portion R in two regions is suppressed, the reduction in the heat-dissipation can be prevented. In addition, the contact area between the coupling portion 621 and the filler is increase by the enlarged portion 628, the heat-dissipation effect is further increased. Moreover, since the filler can be completely filled from one of the regions, the number of nozzles of filling apparatus and the number of movement of the nozzle for filling from the other region can be reduced, and the productivity is improved.

Furthermore, the enlarged portion which the cross-sectional area of the cross-sectional shape of the through-hole may be provided to both of the end portions of the above through holes. For example, a reactor according to an aspect of an embodiment may include a core which includes at least a pair of partial cores disposed via a gap, a coil attached to a part of the core, and a core molding member which is formed integrally by a resin material and which covers the pair of partial cores, in which the core molding member includes a coupling portion which is provided between the pair of partial cores at a location corresponding to the gap, the coupling portion includes a through-hole, and a pair of connection portions which face with each other across the through-hole and which connects a space between the pair of partial cores, the reactor further includes a housing which houses therein the reactor main body having core, the coil, and the core molding member, and a filler molded portion formed of a filler provided between the reactor main body and the housing, and an enlarged portion which the cross-section of the cross-sectional shape of the through-hole may be provided to both of the end portions of the through-holes. Providing the enlarged portion to the end portions of both of the through-holes means that the enlarged portion is provided not only to one of the end portions of through-holes as the above aspect, but is also provided to the other end portion. One of the pair of connection portion of this aspect may also have an opening in communication with the through-hole. Furthermore, the core molding member may include a wall portion standing upright at a location facing with each other across the opening. In addition, the core molding member may include an inclined portion formed of a resin material that becomes thin toward the opening. Moreover, one of the pair of connection portion may include a pair of opposing connection portions which face with each other via a clearance in a direction orthogonal to the connection direction. The other of the pair of connection portion may be disposed at an opposing location between the opposing connection portions, and may be formed with the width equal to or smaller than the clearance between the opposing connection portions. The pair of connection portion may include a tabular portion in the direction orthogonal to each other.

Figure 15B:
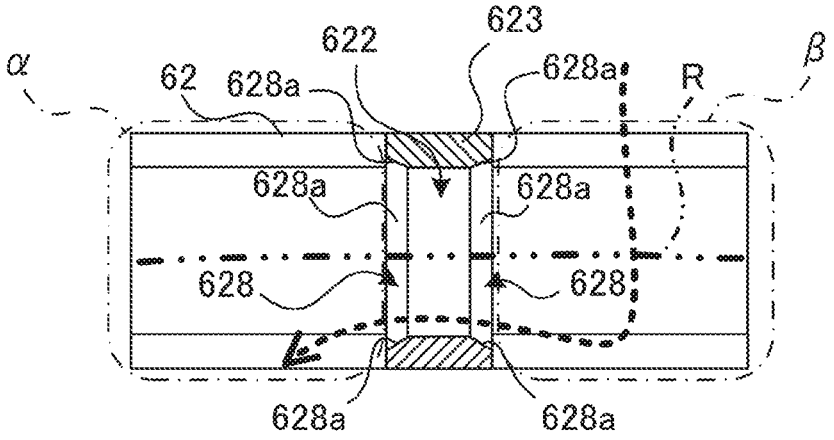
FIG. 15(B) is a cross-sectional view illustrating an example in which both end portions of the through-hole is enlarged.

That is, as illustrated in cross-sectional view of FIG. 15(B), the enlarged portion 628, in which the cross-sectional area orthogonal to the axis in parallel with the winding direction is enlarged toward both of the end portion from the inner side of the coupling portion 621, is provided to the through-hole 622. In detail, the enlarged portion 628 is formed by an inclined surface 628*a* which is provided continuously at the inner surface in parallel with the axis of the through-hole 622 and which is inclined relative to the axis of the through-hole 622. This inclined surface 628*a* is provided across the whole circumference of both of the end portions of the through holes 622. Accordingly, as indicated by a dotted arrow in FIG. 15(B), since the filler may easily flow in from the other end portion of the through-hole 622, the filler may further easily be completely filled in both regions. Therefore, in the present aspect, the problem can be addressed similarly as the above aspect in which the enlarged portion 628 is provided to one of the end portion of the through-hole 622, and excellent effect can be obtained.

Note that the inclined surface 628*a* in the above aspect may be provided to a part of the end portion of the through-hole 622. When the cross-sectional shape of the through-hole 522 is a rectangle, the inclined portion may be provided to one side of either of the end portion of the through-hole 622, may be provided only to two sides along z-axis, or may be provided only to two sides along x-axis. When considering that the casing 3 that is the housing is on lower side where the gravity is applied at the time of filling the filler, it is preferable that the inclined surface 628*a* is provided to at least the bottom side, that is, one horizontal side at the casing 3-side. Furthermore, in addition to one side in the casing 3-side, it is preferable that the inclined surface 628*a* is provided to two side orthogonal to said one side. In addition, although the cross-sectional shape in this aspect is rectangle, the shape is not limited thereto.

Figure 15C:
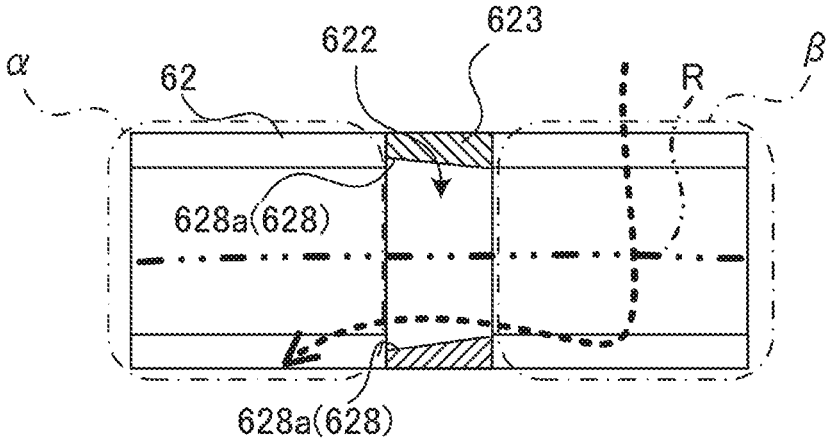
FIG. 15(C) is a cross-sectional view illustrating an example in which an interior of the through-hole is inclined.

Moreover, at least one inner surface of the through-hole 522 may be inclined relative to the axis of the through-hole 622, so that the cross-sectional area of the cross-sectional shape of the through-hole 622 is enlarged toward the enlarged portion 628. Entire inner surface of the through-hole 622 may be inclined, either one of the inner surface of the through-hole 622 may be inclined, only two inner surface along z-axis may be inclined, or only two inner surface along x-axis may be inclined. When considering that the casing 3 that is the housing is on lower side where the gravity is applied at the time of filling the filler, it is preferable that at least inner bottom surface, that is, one horizontal inner surface at the casing 3-side, that is, the housing-side is inclined. Furthermore, in addition to one inner surface in the casing 3-side, it is preferable that two surfaces orthogonal to said one surface are inclined. By inclination, the fluidity of the filler in further improved. Here, the inclination angle relative to the axis of the through-hole 622 and the inclination angle relative to the axis of the inclined surface 628*a* forming the enlarged portion 628 may be the different or the same. When the inclination angles are the same, the inner surface of the through-hole 622 and the inclined surface 628*a* is continuous as illustrated in FIG. 15(C), and in this case, the end portion of the through-hole 622 and the region nearby may be regarded as the inclined surface 628*a* corresponding to the enlarged portion 628. By such a structure, the configuration of the molding may be simplified. Note that inclined portion for improving the fluidity of the filler may be provided to the end portion of the above opening 625, to the inner surface of the above opening 625, etc., to further improve the fluidity of the filler into the through-hole 622 and the plurality of regions.

(5) A restriction portion to restrict the clearance between the partial coils may be provided to the above core molding member. For example, a reactor according to an aspect of an embodiment may include a core which includes at least a pair of partial cores disposed via a gap, a coil attached to a part of the core, and a core molding member which is formed integrally by a resin material and which covers the pair of partial cores, in which the core molding member includes a coupling portion which is provided between the pair of partial cores at a location corresponding to the gap, the coupling portion includes a through-hole, and a pair of connection portions which face with each other across the through-hole and which connects a space between the pair of partial cores, the reactor further includes a housing which houses therein the reactor main body having core, the coil, and the core molding member, and a filler molded portion formed of a filler provided between the reactor main body and the housing, and the coil includes a pair of partial coils attached across the coupling portion, and the reactor includes a restriction portion to restrict the clearance between the partial coils. One of the pair of connection portion in this aspect may also have an opening in communication with the through-hole. Furthermore, the core molding member may include a wall portion standing upright at a location facing with each other across the opening. In addition, the core molding member may include an inclined portion formed of a resin material that becomes thin toward the opening. Moreover, one of the pair of connection portion may include a pair of opposing connection portions which face with each other via a clearance in a direction orthogonal to the connection direction. The other of the pair of connection portion may be disposed at an opposing location between the opposing connection portions, and may be formed with the width equal to or smaller than the clearance between the opposing connection portions. The pair of connection portion may include a tabular portion in the direction orthogonal to each other.

Figure 16:
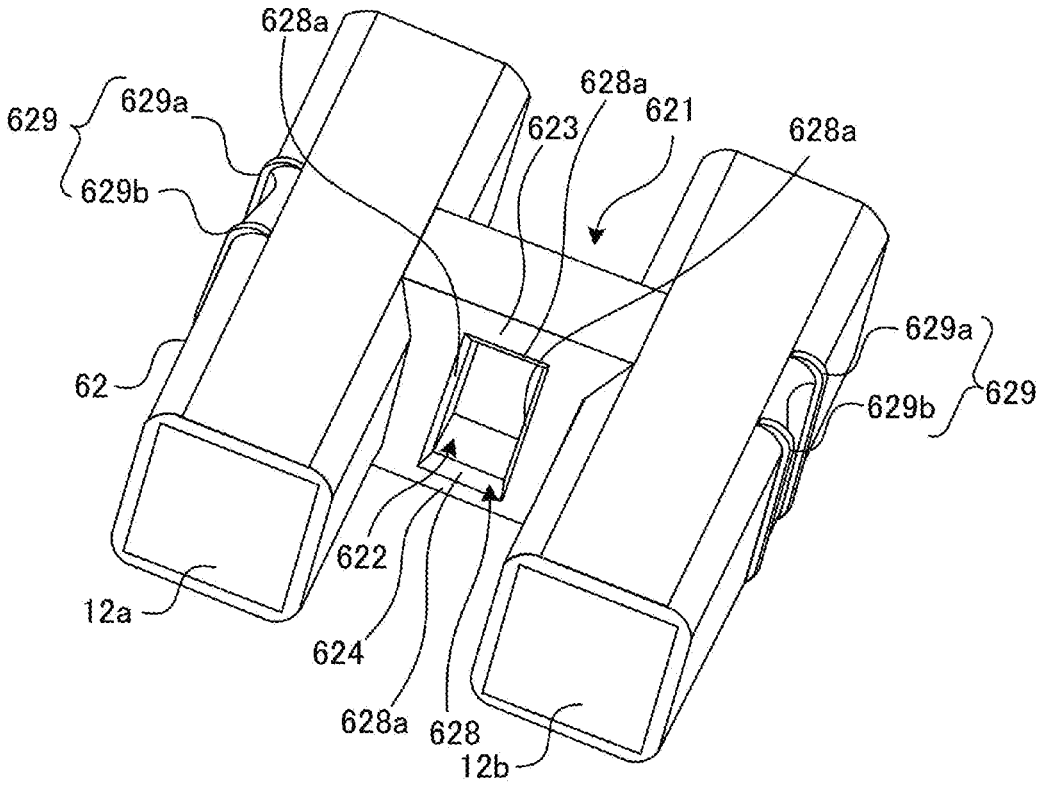
FIG. 16 is a perspective view illustrating an example in which a restriction portion is provided to the core molding member.
Figure 17:
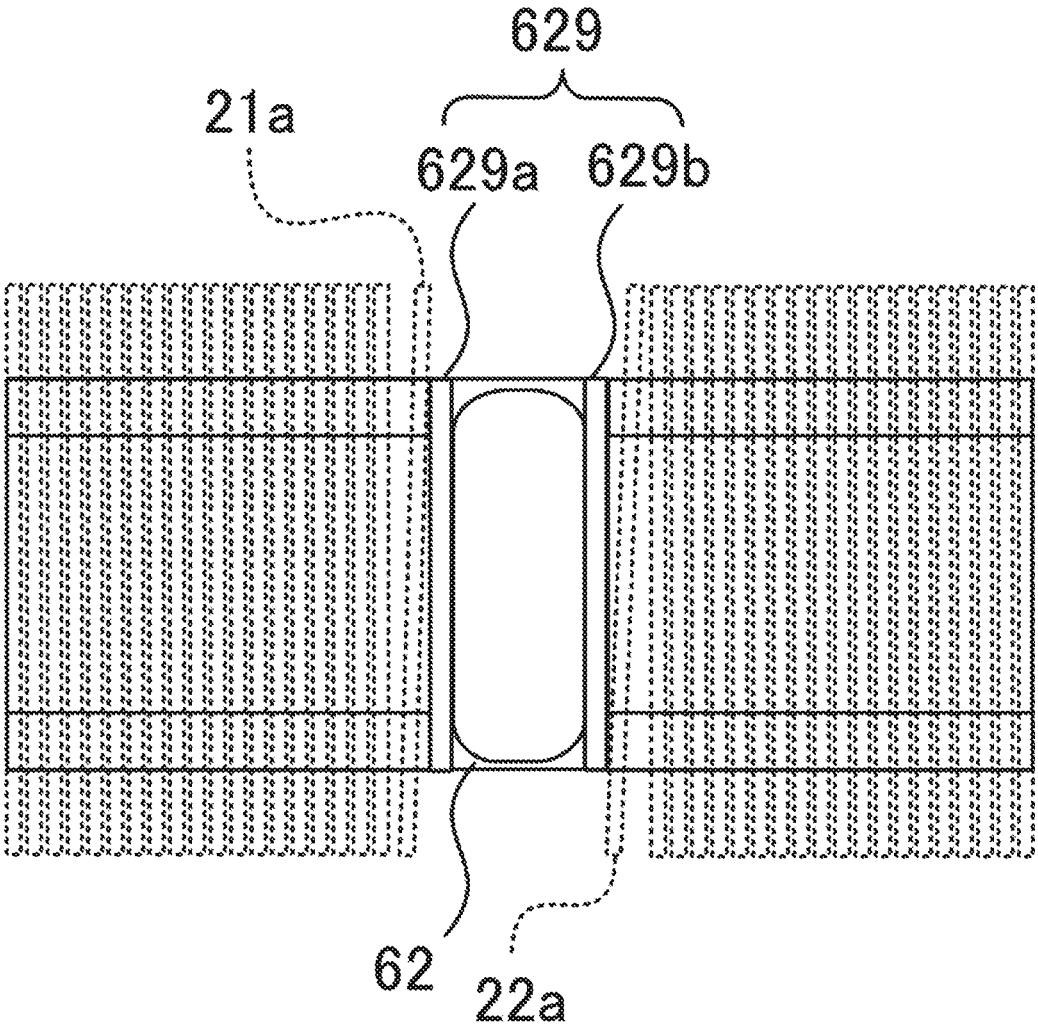
FIG. 17 is a side view of FIG. 16.

As illustrated in FIG. 16, a restriction portion 629 is formed by a pair of protruding portions 629*a* and 629*b* provided to the core molding member 6. The protruding portions 629*a* and 629*b* is provided between a pair of partial coils 21*a* and 22*a* attached across the coupling portion 621 so as to protrude from the outer circumference surface. In detail, the protruding portion 629*a* protrudes in a C-shape extending in the height direction of the core molding member 6. As illustrated in FIG. 17, the protruding portion 629*a* is provided to a position close to the end surfaces of the partial coils 21*a* and 21*b*, and the protruding portion 629*b* is provided to a position close to the end surfaces of the partial coils 22*a* and 22*b*. Between the protruding portion 629*a* and the protruding portion 629*b* is a region filled by the dropped filler. Note that the protruding portion 629*a* and 629*b* is similarly provided to between the pair of partial coils 21*b* and 22*b*. The protruding portion 629*a* is provided to a position close to the end surfaces of the partial coils 21*a* and 21*b*, and the protruding portion 629*b* is provided to a position close to the end surfaces of the partial coils 22*a* and 22*b*. Between the protruding portion 629*a* and the protruding portion 629*b* is a region filled by the dropped filler.

Here, in the casing which houses therein the reactor main body, heat-dissipation effect is improved because heat from the reactor main body is transferred to the casing via the filler. To achieve such heat-dissipation effect, it is preferable that the filler is uniformly filled between the reactor main body and the casing. However, the conductor forming the coil easily deforms even after it is attached to the partial core. When such deformation occurs, region between the partial cores where the filler is filled becomes narrow, and there is a possibility that the filler is not sufficiently filled.

In more detail, the conductor forming the coil easily leans so that the inclination angle relative to the winding direction becomes larger even after it is attached to the partial core. When such leaning of the conductor occurs, a region between the pair of partial coils 21*a* and 22*a* where the filler is filled becomes narrow. The present aspect can address the problem that a region between the pair of partial coils where the filler is filled becomes narrow. That is, in the present aspect, as illustrated in FIG. 17, even when the conductor of the pair of partial coils 21*a* and 22*a* leans, since the restriction portion 629 prevents leaning of the conductor from becoming large and restricts the clearance between the partial coils 21*a* and 21*b*, the region where the filler is filled can be ensured. This function of such a restriction portion 629 is similar for a pair of partial coils 21*b* and 22*b*.

(6) A communication opening which is in communication with the through-hole and where the core is exposed from the core molding member may be provided to the above connection portion. For example, a reactor according to an aspect of an embodiment may include a core which includes at least a pair of partial cores disposed via a gap, a coil attached to a part of the core, and a core molding member which is formed integrally by a resin material and which covers the pair of partial cores, in which the core molding member includes a coupling portion which is provided between the pair of partial cores at a location corresponding to the gap, the coupling portion includes a through-hole, and a pair of connection portions which face with each other across the through-hole and which connects a space between the pair of partial cores, the reactor further includes a housing which houses therein the reactor main body having core, the coil, and the core molding member, and a filler molded portion formed of a filler provided between the reactor main body and the housing, and a communication opening which is in communication with the through-hole and where the core is exposed from the core molding member is provided to the connection portion. One of the pair of connection portion may also have an opening in communication with the through-hole. Furthermore, the core molding member may include a wall portion standing upright at a location facing with each other across the opening. In addition, the core molding member may include an inclined portion formed of a resin material that becomes thin toward the opening. Moreover, one of the pair of connection portion may include a pair of opposing connection portions which face with each other via a clearance in a direction orthogonal to the connection direction. The other of the pair of connection portion may be disposed at an opposing location between the opposing connection portions, and may be formed with the width equal to or smaller than the clearance between the opposing connection portions. The pair of connection portion may include a tabular portion in the direction orthogonal to each other.

Figure 18A:
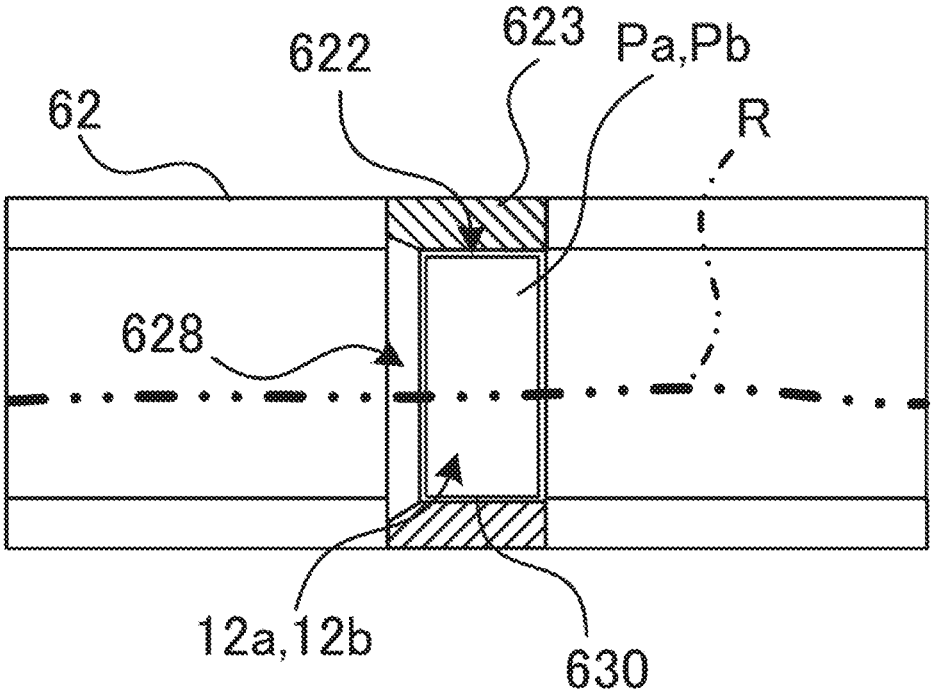
FIG. 18 is a cross-sectional view illustrating an example in which a connection hole is formed in the connection portion.
Figure 18B:
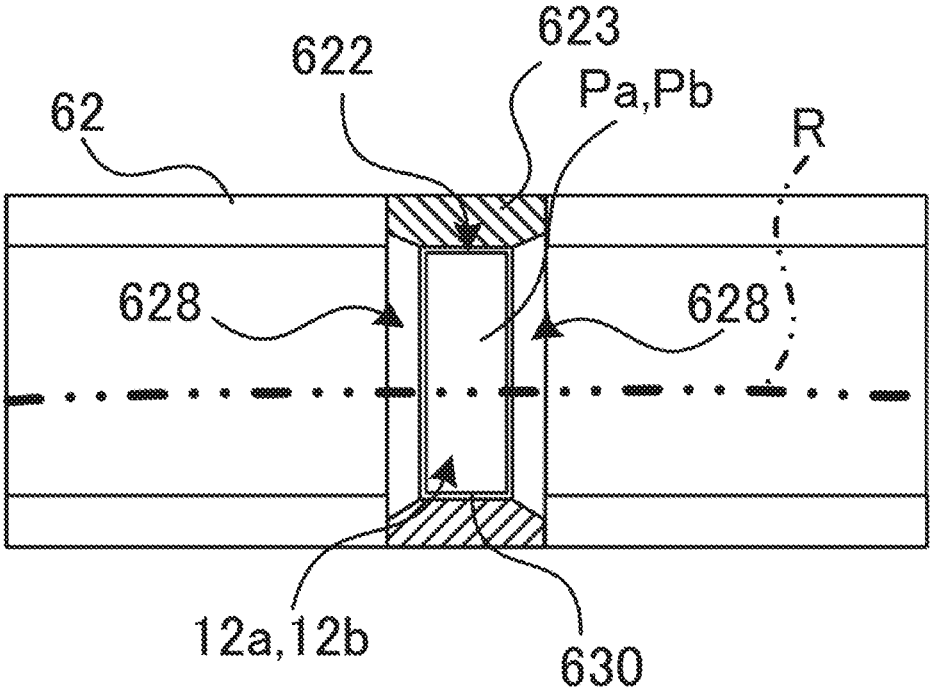

That is, as illustrated in FIGS. 18(A) and 18(B), an communication opening 630, from which the T-shaped cores 12*a* and 12*b* that are the partial cores are exposed, is formed on the inner side surface of the coupling portion 621 facing the through-hole 622. In the example of FIG. 18, the end surfaces of the center protrusions Pa and Pb of the T-shaped cores 12*a* and 12*b* are exposed. When the filler is filled, the filler flown into the through-hole 622 contacts with the T-shaped core 12*a* and 12*b* via the communication opening 630 inside the through-hole, and forms the filler molded portion R.

Here, in the casing which houses therein the reactor main body, heat-dissipation effect is improved because heat from the reactor main body is transferred to the casing via the filler. However, when the resin material corresponding to the magnetic gap between the partial cores is present, heat from the partial cores in the resin material may not be efficiently transferred to the filler.

In detail, since the coil 20 is directly in contact with the filler molded portion R, the heat is easily transferred to the casing 3 that is the housing via the filler molded portion R, however, since the T-shaped core 12*a* and 12*b* that are the pair of partial cores are covered by the core molding member 6 formed of resin material together with the gap, it is difficult for heat to be transferred to the filler molded portion R. In the present aspect, as described above, the problem that heat from the partial cores in the resin material is not efficiently transferred to the filler can be addressed. That is, in the present aspect, since the filler molded portion R directly contacts with the partial cores via the communication opening 630, heat from the core 20 is efficiently transferred to the filler, and the heat-dissipation effect is improved.

REFERENCE SIGNS

100: reactor1: reactor main body
10: core
11*a*, 11*b*: I-shaped core
12*a*, 12*b*: T-shaped core
12*a*, 13*b*: C-shaped core
15: attaching portion
16: attaching hole
Pa, Pb: center protrusion
20: coil
21, 22: coupled coil
21*a*, 21*b*, 22*a*, 22*b*: partial coil
21*c*, 21*d*, 22*c*, 22*d*: end portion
3: casing
31: support
31*a*: fastening hole
32: wall
32*a*, 32*b*: attachment hole
32*c*: pin hole
321, 322, 323, 324: side wall
33: opening
4, 41, 42, 43: bus bar
411, 413, 421, 431: connection portion
412, 422, 432: terminal
412*a*, 422*a*, 432*a*: terminal hole
5, 5A, 5B: terminal stage
51A, 51B: stage portion
51*a*: terminal hole
52A, 52B: extended portion
521: attaching hole
6: core molding member
61*a*, 61*b*, 62: core casing
621: coupling portion
622: through-hole
623, 624: connection portion
623*a*, 624*b*: opposing connection portion
625: opening
626: wall portion
626*a*, 626*b*: tabular piece
627: inclined portion
627*a*, 627*b*: inclined surface
628: enlarged portion
628*a*: inclined surface
629: restriction portion
629*a*, 629*b*: protruding portion
630: communication opening
R: filler molded portion

What is claimed is:

1. A reactor comprising:

a core that comprises at least a pair of T-shaped cores, each having a center protrusion, the at least a pair of T-shaped cores being disposed with a gap therebetween;

a coil attached to a part of the core;

a core molding member which is formed integrally by a resin material and in which the pair of T-shaped cores are embedded;

a housing which houses therein a reactor main body comprising the core, the coil and the core molding member; and a filler molded portion formed of a filler provided between the reactor main body and the housing, wherein:

the core molding member comprises a coupling portion that is provided between the pair of T-shaped cores at a location corresponding to the gap, and the coupling portion is provided with a through-hole filled with the filler, the coupling portion further having a pair of connection portions which face with each other across the through-hole and which connect a space between the pair of T-shaped cores.

2. The reactor according to claim 1, wherein:

the core is annular; and the coupling portion is disposed at an inner-circumference side of the annular core.

3. The reactor according to claim 1, a filler molded portion formed of a filler provided between the reactor main body and the housing, wherein one of the connection portions is provided with an opening in communication with the through-hole.

4. The reactor according to claim 3, wherein the connection portion comprises a wall portion that comprises pieces standing upright at a location facing each other across the opening.

5. The reactor according to claim 3, wherein the connection portion comprises an inclined portion formed of a resin material that becomes thin toward the opening.

6. The reactor according to claim 1, wherein one of the pair of connection portions comprises a pair of opposing connection portions which face with each other via a clearance in an orthogonal direction to a connection direction.

7. The reactor according to claim 6, wherein the other one of the pair of connection portions is disposed between the opposing connection portions so as to face with each other, and is formed by a width that is equal to or smaller than a clearance between the opposing connection portions.

8. The reactor according to claim 1, wherein the pair of connection portions comprises respective tabular portions in a direction orthogonal to each other.

9. The reactor according to claim 1, wherein an enlarged portion which a cross-section of a cross-sectional shape of the through-hole is provided at one end portion of the through-hole.

10. The reactor according to claim 1, wherein enlarged portions which are each a cross-section of a cross-sectional shape of the through-hole are provided at both of a pair of end portions of the through-hole.

11. The reactor according to claim 3, wherein:

the coil includes a pair of partial coils attached across the coupling portion, and a restriction portion which restricts the clearance between a pair of the partial coils is provided to the core molding member.

12. The reactor according to claim 3, wherein a communication opening which is in communication with the through-hole and where the core is exposed from the core molding member is provided to the connection portion.

13. A reactor comprising:

a core that comprises at least a pair of partial cores disposed with a gap therebetween;

a coil attached to a part of the core; and a core molding member which is formed integrally by a resin material and which covers the pair of partial cores, wherein:

the core molding member comprises a coupling portion that is provided between the pair of partial cores at a location corresponding to the gap, the coupling portion is provided with a through-hole, the coupling portion further having a pair of connection portions which face with each other across the through-hole and which connect a space between the pair of partial cores, one of the connection portions comprises a pair of opposing connection portions which face each other via a clearance in a direction which is orthogonal to a connection direction, and another one of the connection portions is disposed between the opposing connection portions so as to face each other, the another one of the connection portions having a width that is equal to or smaller than the clearance between the opposing connection portions.

* * * * *